US009547983B2

(12) United States Patent
Shigezumi et al.

(10) Patent No.: US 9,547,983 B2
(45) Date of Patent: Jan. 17, 2017

(54) ANALYSIS METHOD AND ANALYZING DEVICE

(71) Applicant: FUJITSU LIMITED, Kawasaki-shi, Kanagawa (JP)

(72) Inventors: Junichi Shigezumi, Kawasaki (JP); Tatsuya Asai, Kawasaki (JP); Hiroaki Morikawa, Kawasaki (JP); Hiroya Inakoshi, Tama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/806,941

(22) Filed: Jul. 23, 2015

(65) Prior Publication Data

US 2016/0091326 A1 Mar. 31, 2016

(30) Foreign Application Priority Data

Sep. 30, 2014 (JP) ..... 2014-201500

(51) Int. Cl.
*G08G 1/01* (2006.01)

(52) U.S. Cl.
CPC ..... *G08G 1/0112* (2013.01)

(58) Field of Classification Search
CPC ..... G08G 1/0112; G08G 1/166; B60K 35/00; G01C 21/32; G01C 21/3635; B60W 40/10
USPC . 701/533, 532, 29.2, 123; 345/629; 340/903
See application file for complete search history.

(56) References Cited

U.S. PATENT DOCUMENTS 6,067,031 A * 5/2000 Janky ..... G08G 1/166 180/169
2011/0022295 A1* 1/2011 Lee ..... G01C 21/3635 701/532
2011/0246020 A1* 10/2011 Munnix ..... B60W 40/10 701/29.2
2013/0027426 A1* 1/2013 Sasaki ..... B60K 35/00 345/629
2013/0173147 A1* 7/2013 Takeuchi ..... G01C 21/32 701/123
2013/0191314 A1 7/2013 Li et al.

FOREIGN PATENT DOCUMENTS

| | | |
|---|---|---|
| JP | 2008-282263 | 11/2008 |
| JP | 2012-27557 | 2/2012 |
| JP | 2012-63260 | 3/2012 |
| JP | 2013-148574 | 8/2013 |

* cited by examiner

*Primary Examiner* — Yuri Kan
(74) *Attorney, Agent, or Firm* — Staas & Halsey LLP

(57) ABSTRACT

An analysis method includes: acquiring first path information indicating a first movement path, first velocity information of a first moving body on the first movement path, second path information indicating a second movement path, and second velocity information of a second moving body on the second movement path; calculating, based on a specific rule, a similarity between the first velocity information and the second velocity information when the first path information and the second path information are extracted as candidates to be integrated; determining, based on the similarity, whether the first path information and second path information are to be integrated; and generating graph information to draw at least a part of the first path information and at least a part of the second path information as a single path when it is determined that the first path information and the second path information are to be integrated.

17 Claims, 29 Drawing Sheets

FIG. 4

| START POINT | END POINT | VELOCITY | START POINT | END POINT | VELOCITY |
|---|---|---|---|---|---|
| p1 | p2 | 60 | p7 | p8 | 60 |
| p2 | p3 | 40 | p8 | p9 | 60 |
| p3 | p4 | 80 | p10 | p11 | 50 |
| p5 | p6 | 60 | p11 | p12 | 40 |
| p6 | p7 | 60 | p13 | p14 | 50 |

FIG. 24

| $\delta(\cdot,\cdot)$ | $\alpha_1$ | $\alpha_2$ | $\alpha_3$ | $\alpha_4$ |
|---|---|---|---|---|
| $G_1$ | – | 5 | 2 | 1 |
| $G_2$ | 4 | – | 1 | 2 |
| $G_3$ | 3 | 2 | – | 1 |
| $G_4$ | 3 | 5 | 2 | – |

FIG. 26

| $\delta(\cdot,\cdot)$ | $\alpha_1$ | $\alpha_2$ | $\alpha_3$ | $\alpha_4$ |
|---|---|---|---|---|
| $G_{31}$ | – | 2 | – | 1 |
| $G_{32}$ | 3 | – | – | 1 |
| $G_{33}$ | 3 | 2 | – | – |

ANALYSIS METHOD AND ANALYZING DEVICE

CROSS-REFERENCE TO RELATED APPLICATION

This application is based upon and claims the benefit of priority of the prior Japanese Patent Application No. 2014-201500, filed on Sep. 30, 2014, the entire contents of which are incorporated herein by reference.

FIELD

The embodiment discussed herein is related to a technique for analyzing a movement path of a moving body.

BACKGROUND

Traditionally, there is a technique for executing analysis related to a path of a moving body as spatial information analysis. For example, there is a technique for executing an origin-destination (OD) search so as to search, from a plurality of trajectory data items that are actually observed data, a path on which a specified point is an origin or a destination. In addition, there is a technique for analyzing, from a plurality of trajectory data items, frequent ODs that are combinations (for example, Shinjuku station and Shibuya station, Shinagawa station and Ikebukuro station, and the like) of origins and destinations that appear a predetermined number (for example, 10) of times or more. In addition, there is a technique for analyzing, from trajectory data items, a partial path such as a path extending from Shinagawa station through the outer track of Yamanote line to Ikebukuro station, for example. Furthermore, there is a technique for analyzing, from trajectory data items, a frequent partial path that is a partial path that appears a predetermined number (for example, 10) of times or more. In the path analysis, if a path to be analyzed is identified based on a road network, map data, or the like, appropriate analysis results may be obtained by associating the path with trajectory data items.

In addition, a technique for analyzing a state of a moving body or the like based on information, such as trajectory data or the like, on a movement of the moving body has been proposed. For example, for a device configured to predict a state of a vehicle, a device configured to identify a traveling location by a predetermined road unit and acquire a measurement result indicating the state of the vehicle during the traveling on the road unit has been proposed. The device organizes measurement results obtained from the same road unit into a group and generates traveling data including measurement data based on the measurement results belonging to the group. The device associates the traveling data with the road unit corresponding to the group, stores the traveling data, and predicts the state of the vehicle based on the distance of the road unit.

In addition, a car navigation system has been proposed, which accumulates traveling history data including information of trajectories and velocities of many vehicles that have actually traveled and searches the optimal traveling path using the data.

Techniques related to the above description are disclosed in, for example, Japanese Laid-open Patent Publications Nos. 2008-282263, 2012-63260, 2013-148574, and 2012-27557.

SUMMARY

According to an aspect of the invention, an analysis method executed by a computer, the analysis method includes: acquiring first path information indicating a first movement path, first velocity information of a first moving body on the first movement path, second path information indicating a second movement path, and second velocity information of a second moving body on the second movement path; calculating, based on a specific rule, a similarity between the first velocity information and the second velocity information when the first path information and the second path information are extracted as candidates to be integrated; determining, based on the similarity, whether the first path information and second path information are to be integrated with each other; and generating graph information to be used to draw at least a part of the first path information and at least a part of the second path information as a single path when it is determined that the first path information and the second path information are to be integrated with each other.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 4 is a diagram illustrating an example of velocity information provided between nodes;

FIG. 24 is a diagram illustrating an example of costs of non-approximation to the intermediate planar graphs generated in the first loop of the process of generating a path graph;

FIG. 26 is a diagram illustrating an example of costs of non-approximation to the intermediate planar graphs generated in the second loop of the path graph generation process;

DESCRIPTION OF EMBODIMENT

In the analysis of a path of a moving body using trajectory data, path information that is to be associated with the movement path, indicated by the trajectory data, of the moving body and is to be analyzed may not exist as specific information such as a road network or map data. In this case, an appropriate analysis result is not obtained from the trajectory data. Thus, it is considered that a path graph to be analyzed is generated by integrating movement paths of multiple moving bodies with each other.

In the conventional techniques, however, movement paths of multiple moving bodies are integrated based on similarities of trajectory data of the moving bodies. Thus, movements of the moving bodies may not be sufficiently reflected in a generated path graph.

According to an aspect, an object of a technique according to an embodiment is to generate a path graph in which movements of moving bodies are sufficiently reflected.

An example of the embodiment is described in detail with reference to the accompanying drawings.

Figure 1:
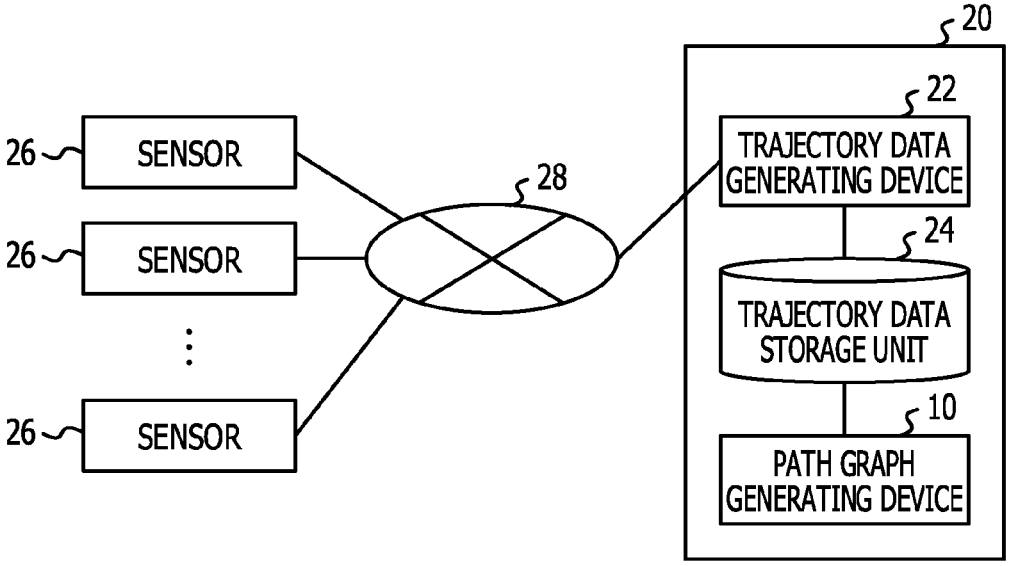
FIG. 1 is a block diagram schematically illustrating the configuration of a path graph generation system according to an embodiment.

As illustrated in FIG. 1, a path graph generating device 10 according to the embodiment, a trajectory data generating device 22, and a trajectory data storage unit 24 are included in a path graph generation system 20. The path graph generating device 10 is an example of a movement path integrating device according to the embodiment.

The trajectory data generating device 22 acquires, through a network 28, observation data items indicating the positions of moving bodies periodically observed by sensors 26. The sensors 26 are configured to observe the positions of the moving bodies. The sensors 26 may be terminals such as mobile phones, smartphones, or the like, global positioning systems (GPSs) used for car navigation systems installed in vehicles, or the like. The terminals are an example of the moving bodies and held by people. The GPSs are an example of the moving bodies. The observation data items include positional data items indicated by latitudes and longitudes of observation points, observation times, and sensor IDs identifying the sensors 26. The trajectory data generating device 22 extracts the acquired observation data items for the sensor IDs, chronologically arranges the positional data items included in the observation data items based on the observation times, and generates trajectory data items.

Trajectories that indicate how the moving bodies move are identified by the trajectory data items. For example, it is assumed that observation points that are indicated by positional data items included in an observation data item including a sensor ID=k are $p_i$ (i=1, 2, . . . , n (n is the total number of the positional data items included in the observation data item including the sensor ID=k). In this case, a trajectory data item that indicates a trajectory $\alpha_k$ is expressed by $\alpha_k=<p_1, p_2, \ldots, p_n>$. The positional data items that indicate the observation points $p_i$ are expressed by $p_i=(x_i, y_i)\epsilon R^2$ ($R^2$ is a two-dimensional space for which real numbers are used as elements) using latitudes $x_i$ and longitudes $y_i$.

Figure 2:
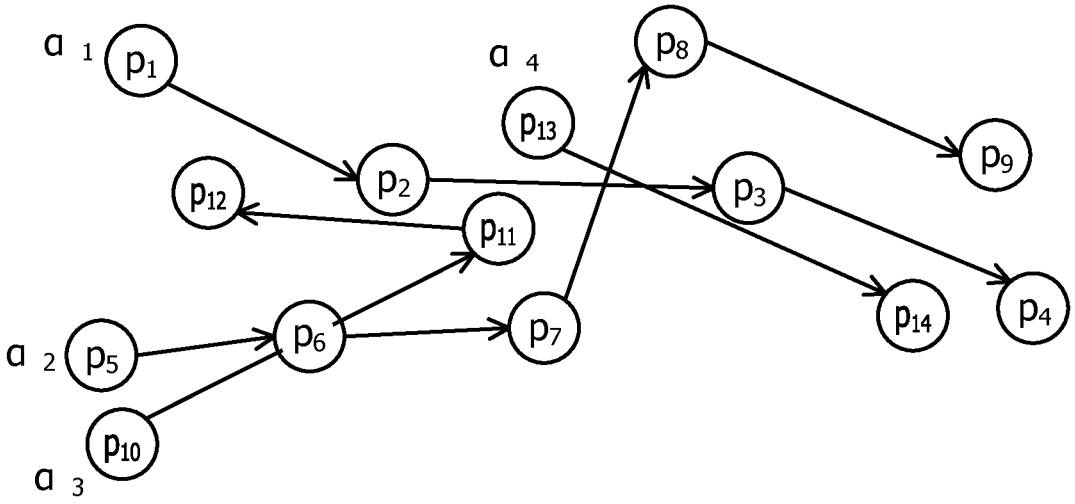
FIG. 2 is a schematic diagram illustrating trajectories indicated by trajectory data items.

For example, trajectory data items $\alpha_1$, $\alpha_2$, $\alpha_3$, and $\alpha_4$ that indicate a plurality of trajectories $\alpha_1$, $\alpha_2$, $\alpha_3$, and $\alpha_4$ schematically illustrated in FIG. 2 are expressed as follows.

A trajectory data set $T=\{\alpha_1, \alpha_2, \alpha_3, \alpha_4\}$ $\alpha_1=<p_1, p_2, p_3, p_4>$ $\alpha_2=<p_5, p_6, p_7, p_8, p_9>$ $\alpha_3=<p_{10}, p_{11}, p_{12}>$ $\alpha_4=<p_{13}, p_{14}>$ In the embodiment, trajectories are indicated by nodes corresponding to observation points and links connecting the nodes corresponding to the observation points that are chronologically continuous. In an example illustrated in FIG. 2, circles indicate the nodes, arrows indicate the links, and symbols within the circles indicating the nodes indicate the identifiers of the nodes.

The trajectory data generating device 22 causes the plurality of generated trajectory data items to be stored in the trajectory data storage unit 24. The trajectory data storage unit 24 may be a storage device included in the trajectory data generating device 22 or may be a storage device separated from the trajectory data generating device 22 and arranged outside the trajectory data generating device 22. In addition, the trajectory data storage device 24 may be a portable storage medium such as a CD-ROM, a DVD-ROM, or a USB memory.

Figure 3:
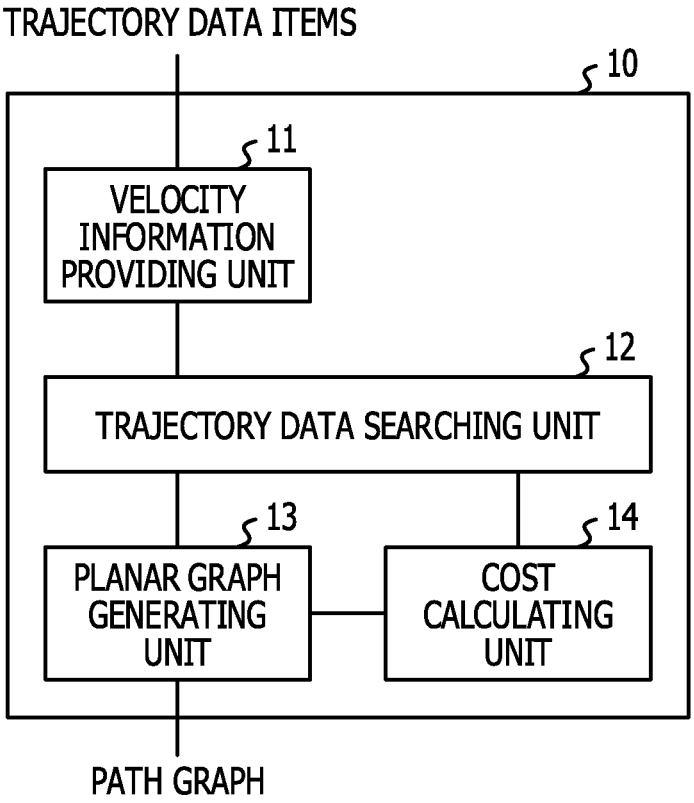
FIG. 3 is a functional block diagram illustrating a path graph generating device according to the embodiment.

As illustrated in FIG. 3, the path graph generating device 10 includes a velocity information providing unit 11, a trajectory data searching unit 12, a planar graph generating unit 13, and a cost calculating unit 14. The velocity information providing unit 11 is an example of an acquirer disclosed herein. The trajectory data searching unit 12 and the cost calculating unit 14 are an example of a determining unit disclosed herein. In addition, the planar graph generating unit 13 is an example of an integrator disclosed herein.

The velocity information providing unit 11 acquires trajectory data items stored in the trajectory data storage unit 24 and provides velocity information to links between continuous observation points of the trajectory data items. For example, the velocity information providing unit 11 calculates a time period of a movement of a moving body between continuous observation points based on observation times at the continuous observation points, calculates a distance between the observation points based on positional data items of the observation points, provides, as a velocity of a link between the observation points, a value obtained by dividing the distance by the time period to the link between the observation points, and stores the value in a predetermined storage region.

For example, as illustrated in FIG. 4, the velocity information providing unit 11 may store velocity information of links between observation points as a list in which the velocity information of the links between the observation points is associated with the identifiers of nodes serving as start points and end points of the links included in trajectories and corresponding to the observation points.

If velocities of the moving bodies are acquired upon the acquisition of observation data items, and the observation data items include information of the velocities at observation points, the average of the velocities indicated by the velocity information held by the continuous observation points may be provided as velocity information of links between the observation points. In addition, if the velocity information of the links between the observation points is already provided to trajectory data items, the provided velocity information may be used without a change. In this case, the velocity information providing unit 11 may be omitted.

The trajectory data searching unit 12 searches, from a set of trajectory data items to which velocity information is provided, a trajectory data item to be integrated into a planar graph next. Specifically, when the planar graph generating unit 13 generates a new planar graph by integrating a trajectory data item into a planar graph already generated at the current stage, the trajectory data searching unit 12 searches a trajectory data item that minimizes a cost to be calculated by the cost calculating unit 14. Hereinafter, a planar graph that is generated by adding a trajectory data item $\alpha$ to a planar graph already generated at the current stage in order to calculate a cost is referred to as an "intermediate planar graph".

Figure 5:
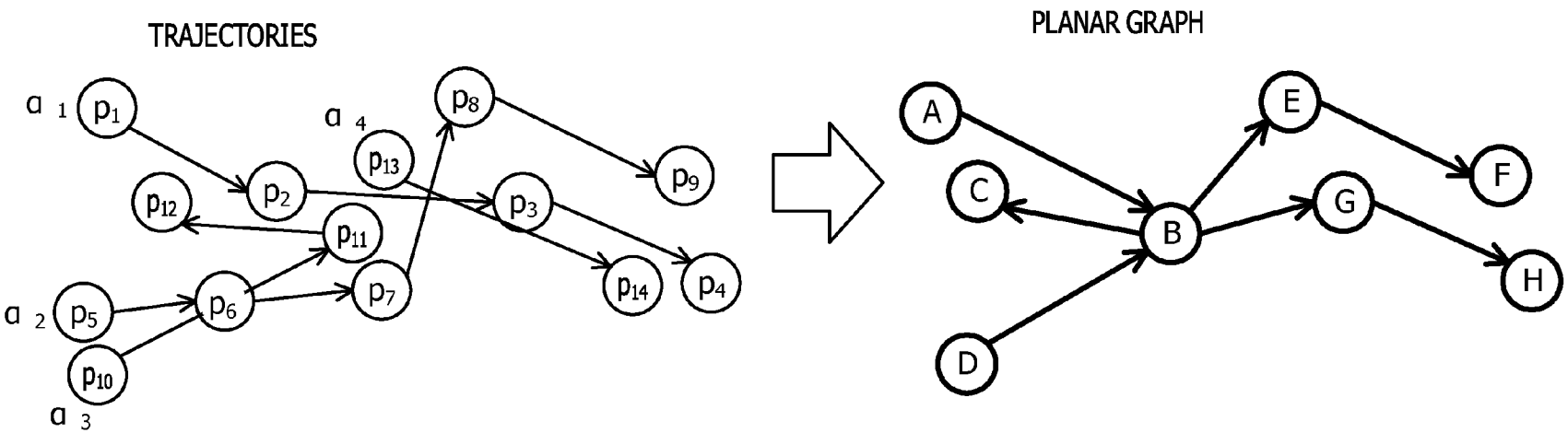
FIG. 5 is a diagram describing the generation of a path graph.

The planar graph generating unit 13 generates a planar graph from trajectory data items by sequentially integrating the trajectory data items searched by the trajectory data searching unit 12 into a planar graph generated at the current stage. Specifically, as illustrated in FIG. 5, the planar graph generating unit 13 organizes parts having high degrees of approximation between trajectories indicated by trajectory data items and generates the planar graph that has only partial paths that are not approximate to each other. In the embodiment, as the degrees of the approximation between the trajectories, distances between the trajectories and differences between velocities indicated by velocity information provided to the trajectory data items indicating the trajectories are used. In the embodiment, since the trajectory data items are sequentially integrated into the planar graph, the distances between the trajectories indicate distances between the trajectories and the partial paths included in the planar graph, and the differences between the velocities indicate differences between the velocities provided to the trajectories and velocities provided to the partial paths.

The planar graph is a graph indicating the plurality of paths by the nodes and the links connecting the nodes. Thus, a part of the planar graph is a part of the paths indicated by the overall planar graph and is hereinafter referred to as a "partial path". The planar graph generating unit 13 registers a set V of node data items indicating the nodes corresponding to the observation points of the trajectory data items and a set $\Sigma$ of link data items indicating the links connecting the nodes and thereby generates the planar graph. The identifiers of the nodes may be used as the node data items. The link data items may be expressed as data identifying nodes of both ends of the links. The links may be directed links or undirected links. If the links are the directed links, the link data items may be expressed in a form of "the identifiers of nodes serving as start points of the links_the identifiers of nodes serving as end points of the links".

For example, in the planar graph illustrated on the right side in FIG. 5, the nodes are indicated by the circles, the identifies of the nodes are indicated by the symbols within the circles, and the links are indicated by the arrows between the nodes. If the planar graph is G=(V, E), the following may be expressed: V={A, B, C, D, E, F, G, H}, and E={A_B, B_C, D_B, B_E, B_G, E_F, G_H}.

In addition, the planar graph generating unit 13 provides, to the links, statistical values such as the averages, weighted averages, or modes of the velocity information provided to the planar graph and the velocity information provided to the trajectory data items integrated into the planar graph as velocity information of the newly generated planar graph. The embodiment describes a case where the averages are used as the statistical values.

The cost calculating unit 14 calculates a cost of a planar graph generated by integrating a certain trajectory data item into a planar graph generated by the planar graph generating unit 13.

Figure 6:
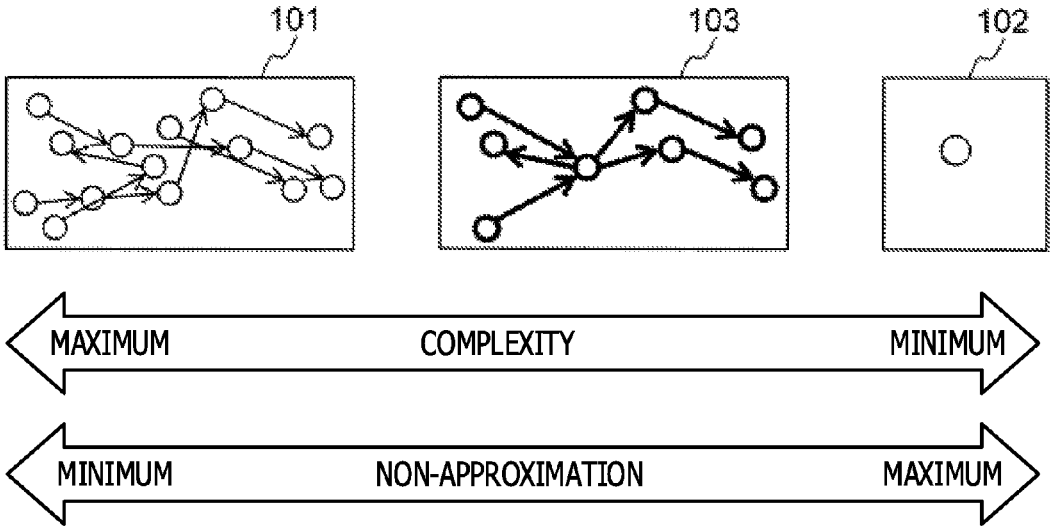
FIG. 6 is a diagram describing the optimal path graph.

Although details are described later, a planar graph generated by integrating a set of all trajectory data items into a planar graph is a path graph to be finally output. For path analysis, it is preferable that the path graph sufficiently indicates the overall trajectory data items and be a simple graph as much as possible. For example, as illustrated in FIG. 6, a path graph 101 indicates the original and most correctly reproduced trajectory data items, and non-approximation to the original trajectory data items indicated by the path graph 101 is minimal. The path graph 101, however, has the maximum complexity. If the path graph 101 is used for the path analysis, the amount of data to be calculated may increase and the accuracy of the analysis may be reduced. A path graph 102 is generated by integrating the original trajectory data items with each other so as to cause the original trajectory data items to be in the simplest state and has the minimum complexity. However, the original trajectory data items are not approximated at all in the path graph 102, and the path graph 102 is not able to be used for the path analysis.

In the embodiment, the cost calculating unit 14 calculates a cost based on two costs, complexity and non-approximation. Then, the planar graph generating unit 13 generates a planar graph that has low complexity and low non-approximation and is approximate for the path analysis, like a planar graph 103 illustrated in FIG. 6.

In the embodiment, the cost calculating unit 14 calculates a cost C obtained by summing a cost $\Sigma_{\alpha\epsilon T}\delta(G, \alpha)$ of non-approximation and a cost $|G|$ of complexity or calculates the cost $C=\Sigma_{\alpha\epsilon T}\delta(G, \alpha)+|G|$. The cost $\Sigma_{\alpha\epsilon T}\delta(G, \alpha)$ of the non-approximation and the cost $|G|$ of the complexity are described in detail below.

First, the cost $\Sigma_{\alpha\epsilon T}\delta(G, \alpha)$ of the non-approximation is described below. As described above, a planar graph G is generated by sequentially integrating trajectory data items into a planar graph already generated at the current stage one by one. $\delta(G, \alpha)$ of the cost $\Sigma_{\alpha\epsilon T}\delta(G, \alpha)$ of the non-approximation is a value indicating a degree of non-approximation between a partial path included in the planar graph G and a trajectory $\alpha$ indicated by a trajectory data item $\alpha$. The larger the value of $\delta(G, \alpha)$, the larger the degree of the non-approximation. If a partial path included in the planar graph G matches a trajectory $\alpha$, $\delta(G, \alpha)$ is 0.

As described above, in the embodiment, whether or not a partial path included in the planar graph G is approximate to a trajectory $\alpha$ is determined based on a distance between the partial path and the trajectory and the difference between velocity information provided to the partial path and velocity information provided to a trajectory data item $\alpha$ indicating the trajectory $\alpha$.

For example, a cost $\delta(G, \alpha)$ of non-approximation between a partial path $\Pi$ included in the planar graph G illustrated in FIG. 7 and the trajectory $\alpha$ is described below. Numbers provided to links of the partial path $\Pi$ and provided to a link of the trajectory $\alpha$ indicate velocities (km/h).

Although a specific process is described later, the planar generator 13 first uses a Fréchet distance or the like as a distance function to extract a distance approximation region 104 in which distances between the partial path $\Pi$ and the trajectory $\alpha$ are equal to or smaller than a predetermined threshold $\epsilon$.

The planar graph generating unit 13 associates nodes, included in the distance approximation region 104, of the partial path $\Pi$ with nodes, included in the distance approximation region 104, of the trajectory $\alpha$, while distances between the nodes of the partial path $\Pi$ and the nodes of the trajectory $\alpha$ are small. Then, the planar graph generating unit 13 compares a velocity provided to the partial path $\Pi$ for an interval indicated by the associated nodes of the partial path $\Pi$ with a velocity provided to the trajectory $\alpha$ for an interval indicated by the associated nodes of the trajectory $\alpha$ and corresponding to the interval of the partial path. Then, the planar graph generating unit 13 extracts an approximation region in which the difference between the velocity provided to the partial path $\Pi$ and the velocity provided to the trajectory $\alpha$ is equal to or smaller than a predetermined threshold vth.

Figure 7:
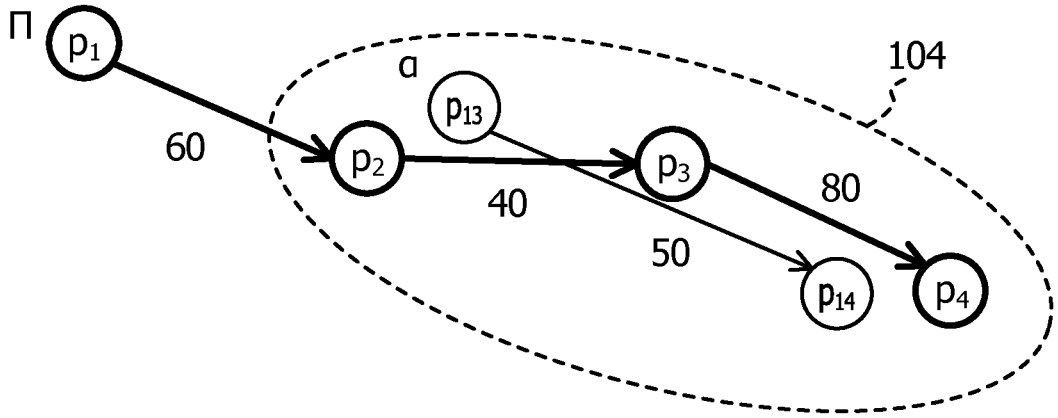
FIG. 7 is a diagram describing an example of a distance approximation region.
Figure 8:
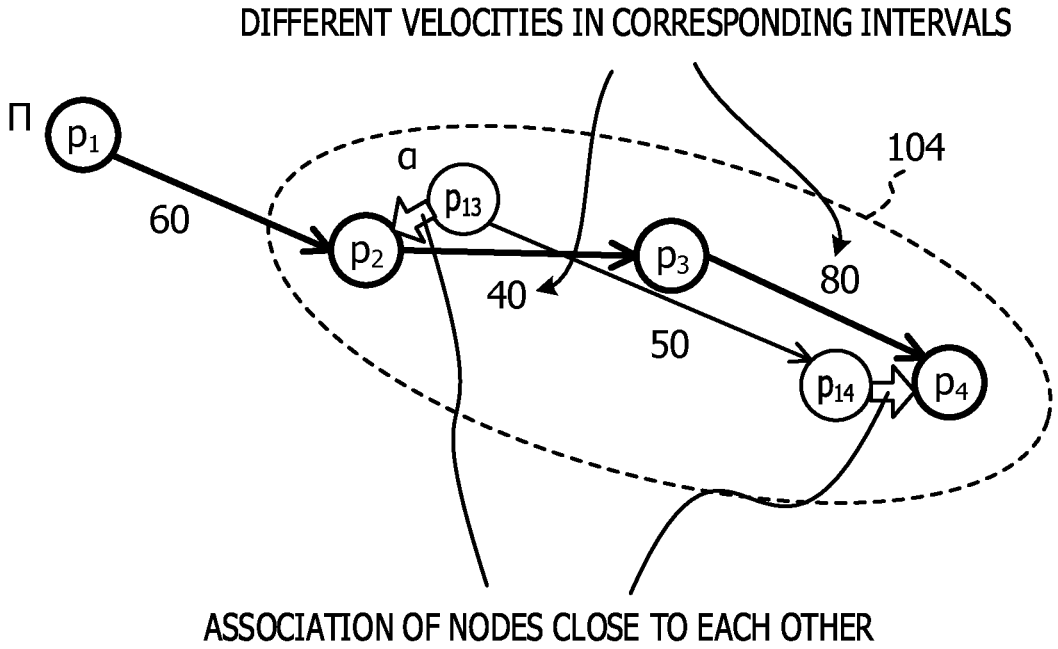
FIG. 8 is a diagram describing parts at which velocities are different.

Since the observation interval of the trajectory $\alpha$ is large in the distance approximation region 104 illustrated in FIG. 7, the nodes of the trajectory $\alpha$ are not associated with the nodes of the partial path $\Pi$ on a one-to-one basis in the distance approximation region 104. As illustrated in FIG. 8, velocities provided to the partial path $\Pi$ for corresponding intervals indicated by the associated nodes of the partial path $\Pi$ are different. In this case, in order to compare the velocities within the corresponding intervals, it is considered that the average of the velocities within the corresponding intervals indicated by the associated nodes of the partial path $\Pi$ is calculated and that the calculated average is simply compared with the velocity provided to the trajectory $\alpha$ for the corresponding interval indicated by the associated nodes of the trajectory $\alpha$. In an example illustrated in FIG. 8, the velocity within the corresponding interval indicated by the associated nodes of the trajectory $\alpha$ is a velocity "50" provided to a link $p_{13}_p_{14}$. The velocity within the corresponding interval indicated by the associated nodes of the partial path $\Pi$ is the average of a velocity "40" provided to a link $p_2_p_3$ and a velocity "80" provided to a link $p_3_p_4$ or is "60". Thus, the difference between the velocity provided to the partial path $\Pi$ for the corresponding interval indicated by the associated nodes of the partial path $\Pi$ and the velocity provided to the trajectory $\alpha$ for the corresponding interval indicated by the associated nodes of the trajectory $\alpha$ is "10". For example, if the threshold vth is 10, a region that is the same as the distance approximation region 104 is extracted as the approximation region.

In the example illustrated in FIG. 8, however, the difference between the velocity "80" provided to the link $p_3_p_4$ of the partial path $\Pi$ and the velocity "50" provided to the link $p_{13}_p_{14}$ of the trajectory $\alpha$ is "30" and exceeds the threshold vth. As described above, in the example in which the average of the velocities within the corresponding intervals indicated by the associated nodes is used, the part at which the difference between the velocities exceeds the threshold vth is extracted as a part of the approximation region, and non-approximation between the partial path $\Pi$ and the trajectory $\alpha$ may not be accurately calculated in consideration of velocity information. In the example illustrated in FIG. 8, the part at which the velocities are different is included in the partial path $\Pi$. This problem may occur if a part at which velocities are different is included in the trajectory $\alpha$.

Figure 9:
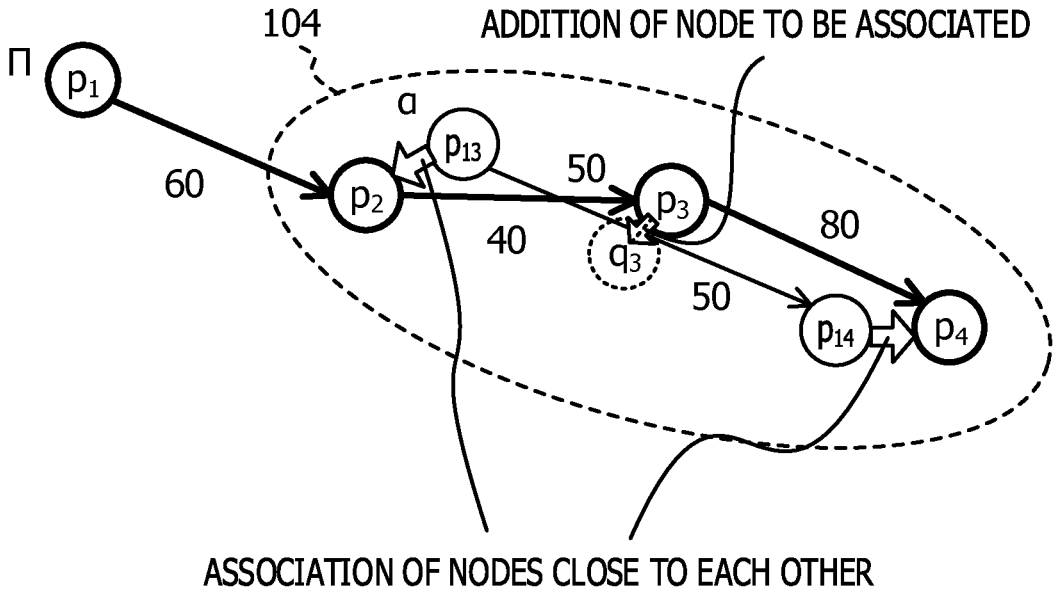
FIG. 9 is a diagram describing the association of nodes.

In the embodiment, a node that corresponds to a part at which velocities of a partial path or trajectory are different is added onto a link of the other of the partial path and trajectory, and velocity information provided to the original link is provided to links divided by the added node. For example, as illustrated in FIG. 9, a node $q_3$, which corresponds to the node $p_3$ corresponding to the part at which the velocities are different and that is included in the partial path $\Pi$, is added onto the link $p_{13}_p_{14}$ of the trajectory $\alpha$. The position of the added node may be a position that is located on the link and at which the distance between the added node and the corresponding node $p_3$ is minimal. Then, the velocity "50" provided to the original link $p_{13}_p_{14}$ is provided to a link $p_{13}_q_3$ and a link $q_3_p_{14}$.

Figure 10:
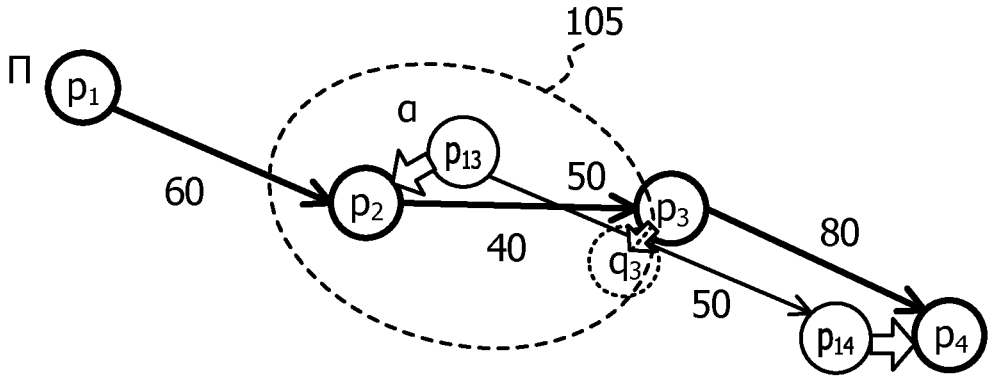
FIG. 10 is a diagram describing an example of an approximation region.

As illustrated in FIG. 10, by the addition of the node, an approximation region 105 in which distances between the partial path $\Pi$ and the trajectory $\alpha$ are small and the difference between the velocities are small may be accurately extracted.

The cost calculating unit 14 calculates a value $\delta(G, \alpha)$ indicating a degree of non-approximation between the partial path $\Pi$ included in the planar graph G and the trajectory $\alpha$ based on an element of a part that is included in the trajectory $\alpha$ and is not approximated to the partial path $\Pi$ included in the planar graph G. For example, the value $\delta(G, \alpha)$ may be the number of nodes or links that are included in the trajectory $\alpha$ and are not included in the approximation region 105, or the value $\delta(G, \alpha)$ may be the sum of the number of the nodes and the number of the links. The value $\delta(G, \alpha)$ may be the sum of the lengths of the links that are included in the trajectory $\alpha$ and are not included in the approximation region 105. In addition, a circle that has a predetermined area and includes all nodes that are included in the trajectory $\alpha$ and are not included in the approximation region 105 is assumed. If a link that is included in the trajectory $\alpha$ and is not included in the approximation region 105 exists, a rectangular of which a central axis in its longitudinal direction is the link that is included in the trajectory $\alpha$ and is not included in the approximation region 105 is assumed. The value $\delta(G, \alpha)$ may be the sum of the area of the assumed circle and the area of the assumed rectangle. Furthermore, the value $\delta(G, \alpha)$ may be a distance to a node that is included in the trajectory $\alpha$ and farthest from the approximation region 105 among nodes that are included in the trajectory $\alpha$ and are not included in the approximation region 105. The value $\delta(G, \alpha)$ may be a combination of the aforementioned values. The embodiment describes a case where the value $\delta(G, \alpha)$ is the number of nodes that are included in the trajectory $\alpha$ and are not included in the approximation region 105. In the example illustrated in FIG. 10, the node $p_{14}$ of the trajectory $\alpha$ is not included in the approximation region 105, and the value $\delta(G, \alpha)$ is 1.

The cost $\Sigma_{\alpha\epsilon T}\delta(G, \alpha)$ of the non-approximation is the sum of values $\delta(G, \alpha)$ calculated for trajectory data items that are yet to be integrated into the planar graph G. Thus, as the cost $\Sigma_{\alpha\epsilon T}\delta(G, \alpha)$ of the non-approximation is reduced, the trajectory data items that are yet to be integrated into the planar graph G are more approximated.

Next, the cost $|G|$ of the complexity is described. The cost $|G|$ of the complexity is a value indicating a degree of the complexity of the planar graph G. The cost calculating unit 14 may calculate, as the cost |G| of the complexity, the number of nodes included in the planar graph G, the number of links included in the planar graph G, the sum of the lengths of the links included in the planar graph G, or a combination of these values. The embodiment describes a case where the cost |G| of the complexity is the number of the nodes included in the planar graph G.

The embodiment describes a case where the sum of the cost $\Sigma_{\alpha\in T}\delta(G, \alpha)$ of the non-approximation and the cost |G| of the complexity is the cost C. A method of integrating the cost $\Sigma_{\alpha\in T}\delta(G, \alpha)$ of the non-approximation with the cost |G| of the complexity is not limited to this. For example, as described below, the cost C may be calculated to be the sum of the two costs weighted.

$C=\Sigma_{\alpha\in T}\delta(G, \alpha)+\lambda|G|$ (however, $\lambda>0$, and $\lambda$ is a fixed value). In this case, $\lambda$ may be finely adjusted in order to avoid a case where a search (described later) of a trajectory data item is immediately terminated.

In addition, the cost C may be calculated to be the product of the two costs. It is sufficient if an appropriate integration method is selected based on the physical meanings of the two costs. In the embodiment, since the two costs are calculated using the numbers of elements such as nodes and links and have the same physical meaning, the integration of the costs by the summing used in the embodiment, the summing of the weighted costs, or the like is appropriate.

Figure 11:
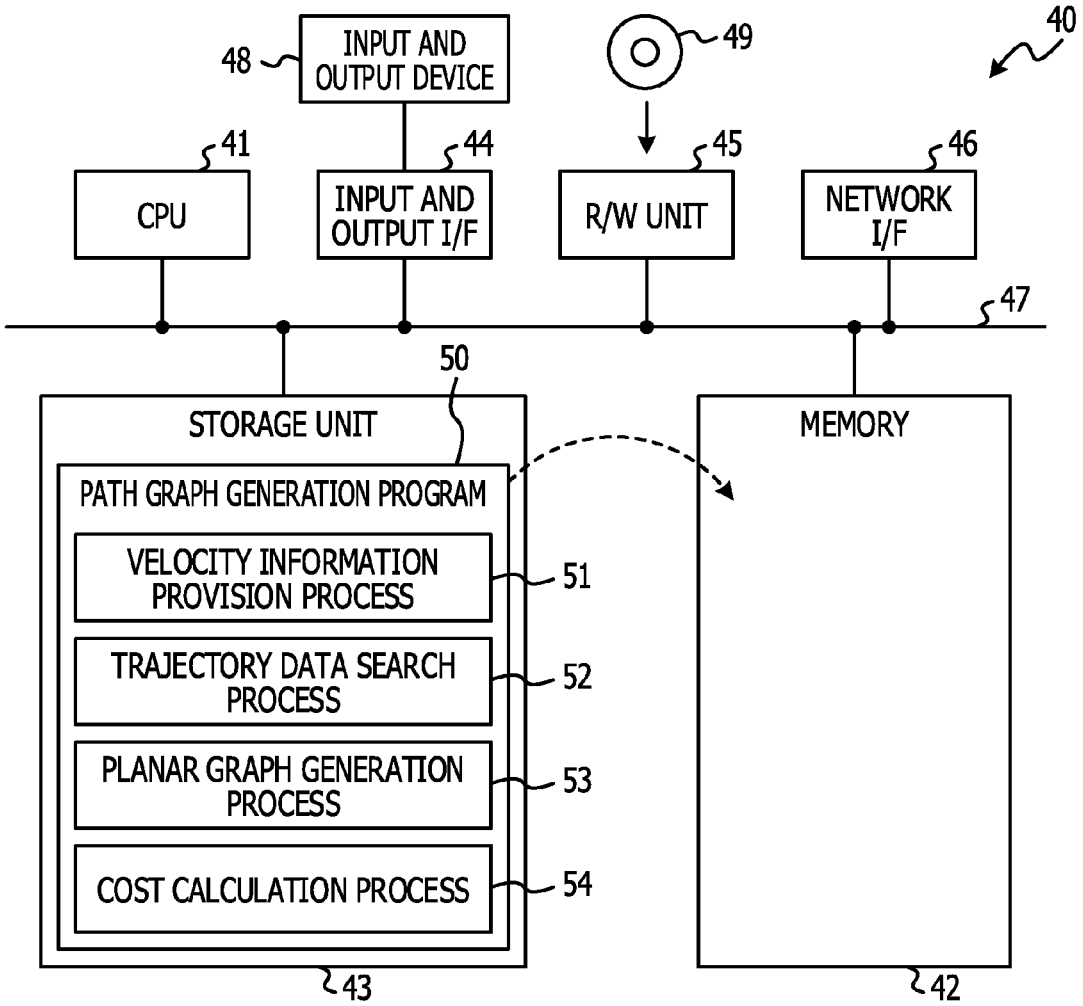
FIG. 11 is a block diagram schematically illustrating the configuration of a computer that functions as the path graph generating device according to the embodiment.

The path graph generating device 10 may be achieved by a computer 40 illustrated in FIG. 11, for example. The computer 40 includes a CPU 41, a memory 42 as a temporal storage region, and a nonvolatile storage unit 43. The computer 40 includes an input and output interface (I/F) 44 to which an input and output device 48 is connected. The computer 40 includes a reading and writing (R/W) unit 45 and a network I/F 46. The R/W unit 45 controls reading and writing of data from and in a recording medium 49. The network I/F 46 is connected to a network such as the Internet. The CPU 41, the memory 42, the storage unit 43, the input and output I/F 44, the R/W unit 45, and the network I/F 46 are connected to each other through a bus 47.

The storage unit 43 may be achieved by a hard disk drive (HDD), a solid state drive (SSD), a flash memory, or the like. In the storage unit 43 as a storage medium, a path graph generation program 50 that causes the computer 40 to function as the path graph generation device 10 is stored. The path graph generation program 50 is an example of a movement path integration program disclosed herein.

The CPU 41 reads the path graph generation program 50 from the storage unit 43, loads the path graph generation program 50 into the memory 42, and sequentially executes processes included in the path graph generation program 50. The path graph generation program 50 includes a velocity information provision process 51, a trajectory data search process 52, a planar graph generation process 53, and a cost calculation process 54.

The CPU 41 executes the velocity information provision process 51 and thereby operates as the velocity information providing unit 11 illustrated in FIG. 3. The CPU 41 executes the trajectory data search process 52 and thereby operates as the trajectory data searching unit 12 illustrated in FIG. 3. The CPU 41 executes the planar graph generation process 53 and thereby operates as the planar graph generating unit 13 illustrated in FIG. 3. The CPU 41 executes the cost calculation process 54 and thereby operates as the cost calculating unit 14 illustrated in FIG. 3. Thus, the computer 40 executes the path graph generation program 50 and thereby functions as the path graph generating device 10.

The path graph generating device 10 may be achieved by a semiconductor integrated circuit. More specifically, the path graph generating device 10 may be achieved by an application specific integrated circuit (ASIC) or the like.

Next, effects of the path graph generation system 20 according to the embodiment are described. The trajectory data generating device 22 acquires, through the network 28, observation data items observed by the plurality of sensors 26, generates trajectory data items from the observation data items, and causes the trajectory data items to be stored in the trajectory data storage unit 24. When the trajectory data set T stored in the trajectory data storage unit 24 is input to the path graph generating device 10, the path graph generating device 10 executes the path graph generation process illustrated in FIG. 12. The path graph generation process that is executed by the path graph generating device 10 is an example of a movement path integration method according to the embodiment.

Figure 12:
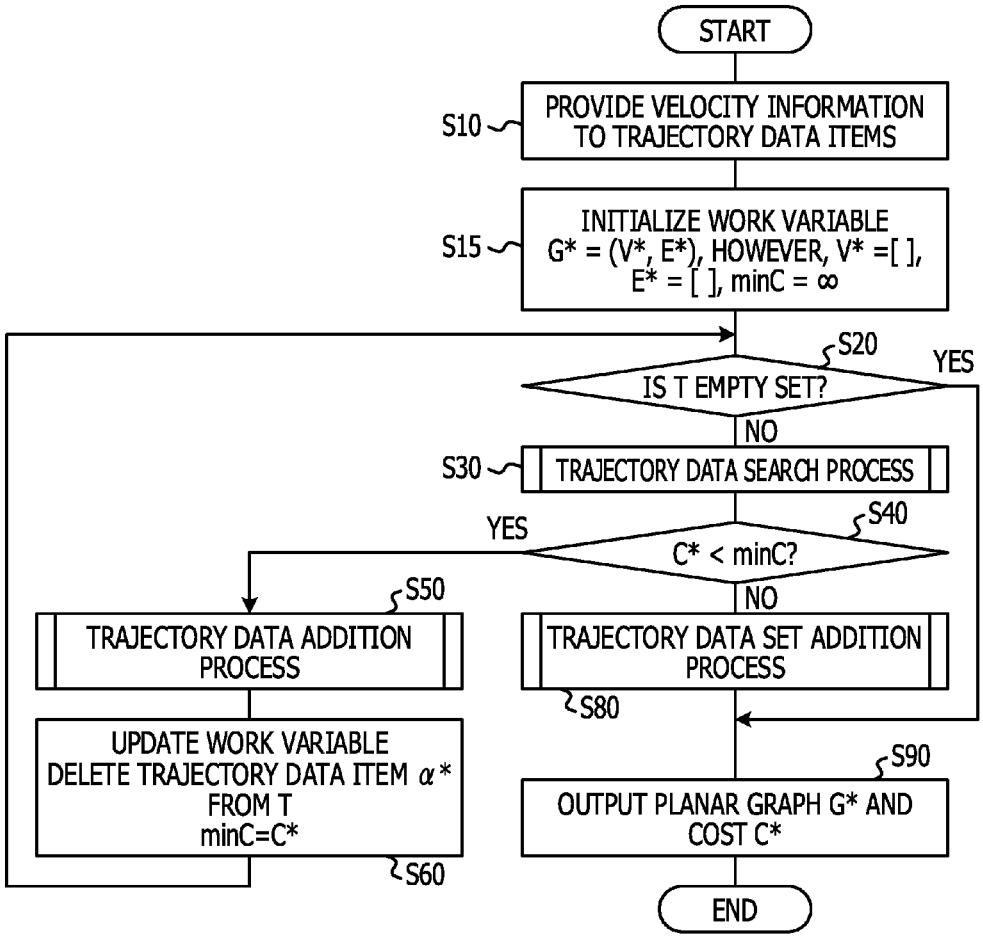
FIG. 12 is a flowchart of an example of a path graph generation process.

In step S10 of the path graph generation process illustrated in FIG. 12, the velocity information providing unit 11 receives the input trajectory data set T. Then, the velocity information providing unit 11 calculates a time period of a movement between continuous observation points based on observation times at the continuous observation points and calculates a distance between the observation points from positional data items of the observation points for each of trajectory data items included in the trajectory data set T. Then, the velocity information providing unit 11 provides, as a velocity of a link between the observation points, a value obtained by dividing the calculated distance by the calculated time period to the link between the observation points and stores the velocity in the predetermined storage region.

Next, in step S15, the trajectory data searching unit 12 sets, as the initialization of a work variable to be used for the path graph generation process, a set V* of nodes forming a planar graph G* and a set E* of links forming the planar graph G* to empty sets. Hereinafter, the planar graph G* indicates a planar graph generated by adding searched trajectory data items $\alpha^*$. In addition, a planar graph G to which a symbol "*" is not added indicates an intermediate planar graph generated in order to calculate the cost, and G=(V, E). In addition, the trajectory data searching unit 12 sets a sufficiently large value such as an infinite value for the minimum cost minC that is the minimum value of the cost C of the planar graph G.

Next, in step S20, the trajectory data searching unit 12 determines whether or not the trajectory data set T is an empty set. If the trajectory data set T is not the empty set, the process proceeds to step S30 and the trajectory data search process that is illustrated in FIG. 13 in detail is executed.

Figure 13:
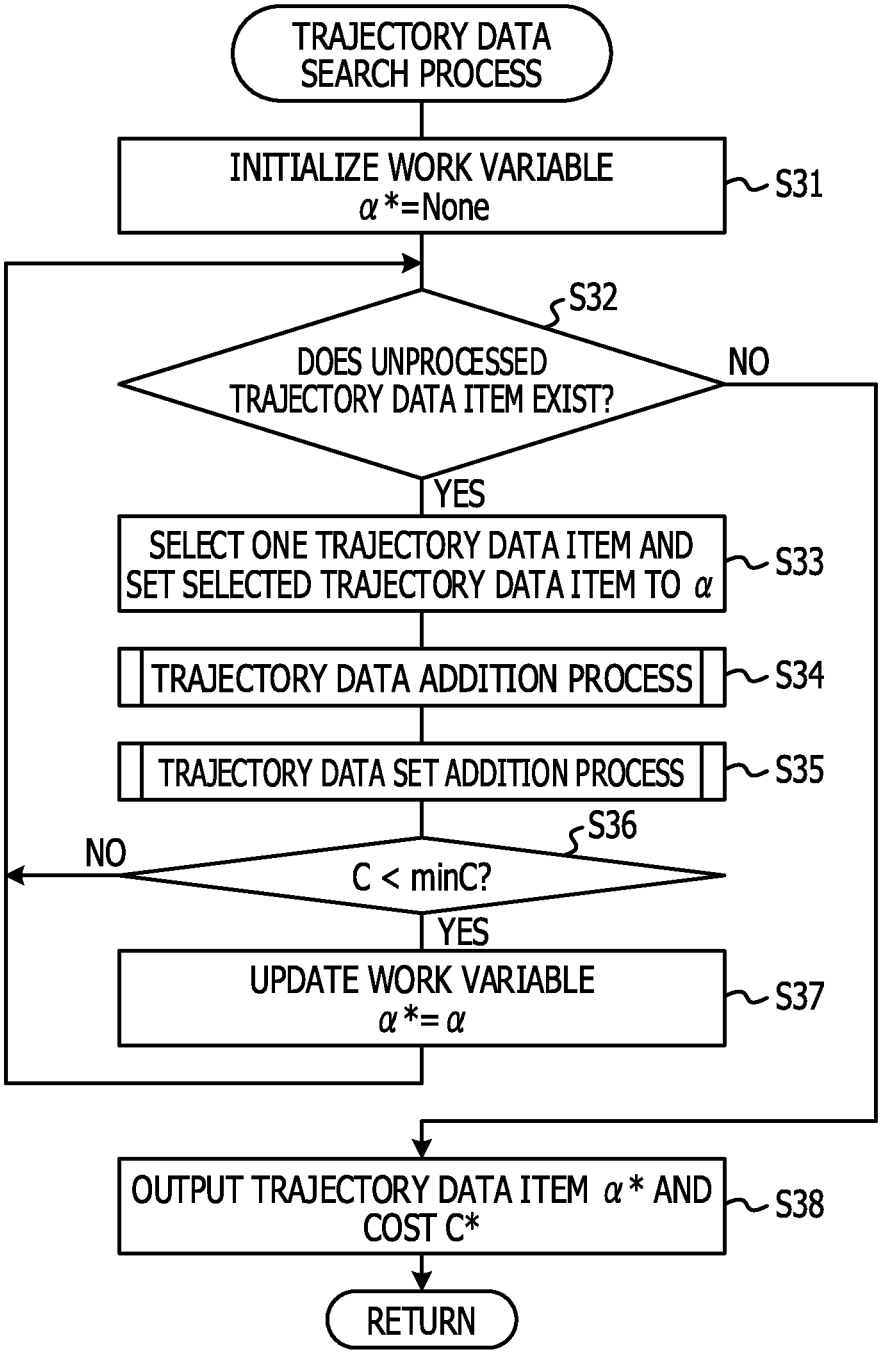
FIG. 13 is a flowchart of an example of a trajectory data search process.

In step S31 of the trajectory data search process illustrated in FIG. 13, the trajectory data searching unit 12 sets, as the initialization of a work variable to be used for the trajectory data search process, "none" for $\alpha^*$ representing a trajectory data item that is a search result.

Next, in step S32, the trajectory data searching unit 12 determines whether or not a trajectory data item that is yet to be processed or yet to be searched exists in the trajectory data set T. If the trajectory data item that is yet to be processed exists, the process proceeds to step S33 and the trajectory data searching unit 12 selects, from among the trajectory data set T, one of trajectory data items that are yet to be processed and sets the selected trajectory data item to a trajectory data item $\alpha$. Next, in step S34, the trajectory data addition process is executed, which is illustrated in FIG. 14 and described below in detail.

Figure 14:
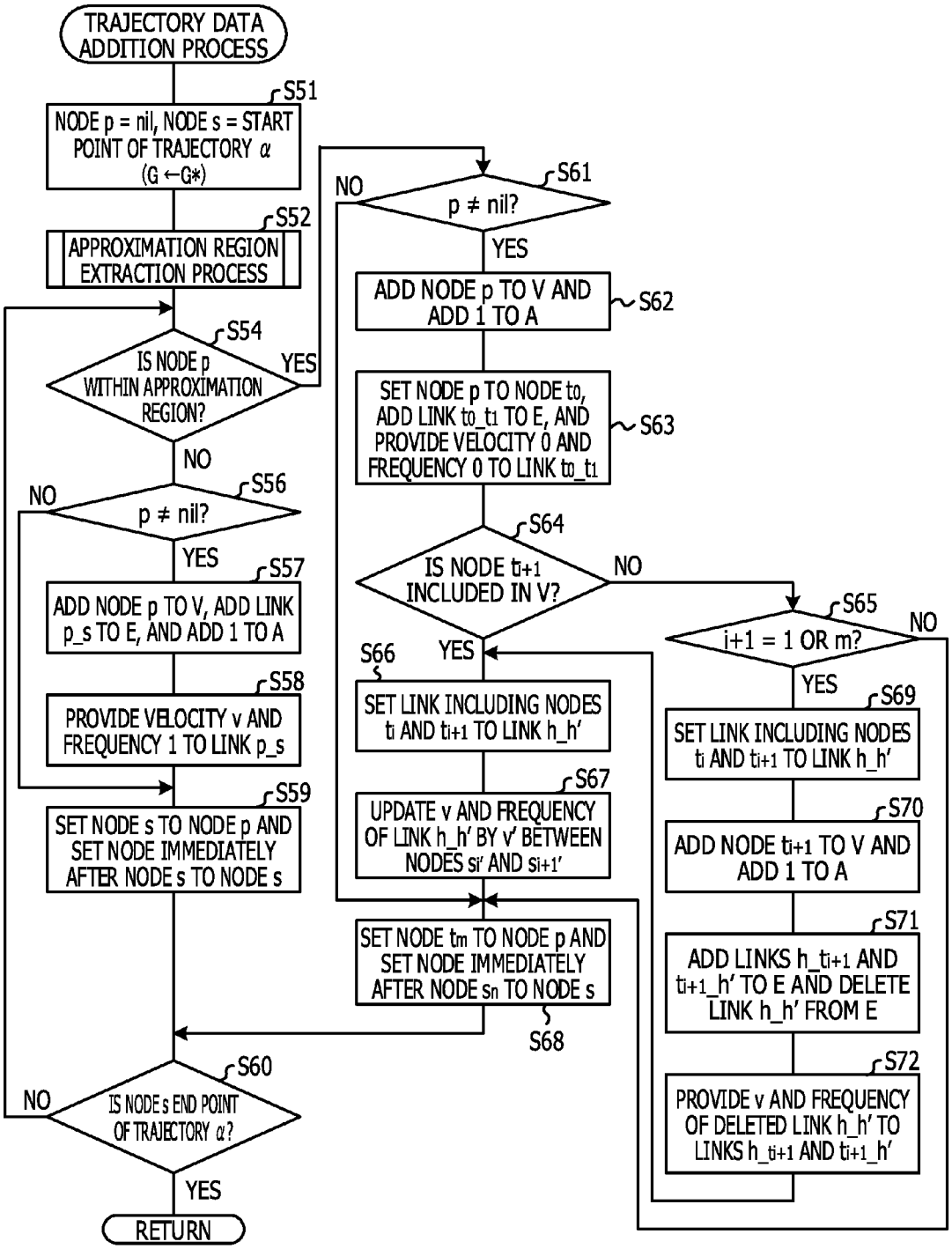
FIG. 14 is a flowchart of an example of a trajectory data addition process.

In step S51 of the trajectory data addition process illustrated in FIG. 14, the planar graph generating unit 13 sets nil for a node p to be processed and sets, to a node s, a start point of a trajectory $\alpha$ indicated by the trajectory data item $\alpha$ set in the aforementioned step S33. The node p is a node included in the trajectory $\alpha$ and is located immediately before the node s. In addition, the planar graph generating unit 13 sets the planar graph G* to an intermediate planar graph G for the calculation of the cost. Next, in step S52, an approximation region extraction process that is illustrated in FIG. 15 in detail is executed to extract the approximation region 105 of the partial path $\Pi$ included in the planar graph G and the trajectory $\alpha$.

Figure 15:
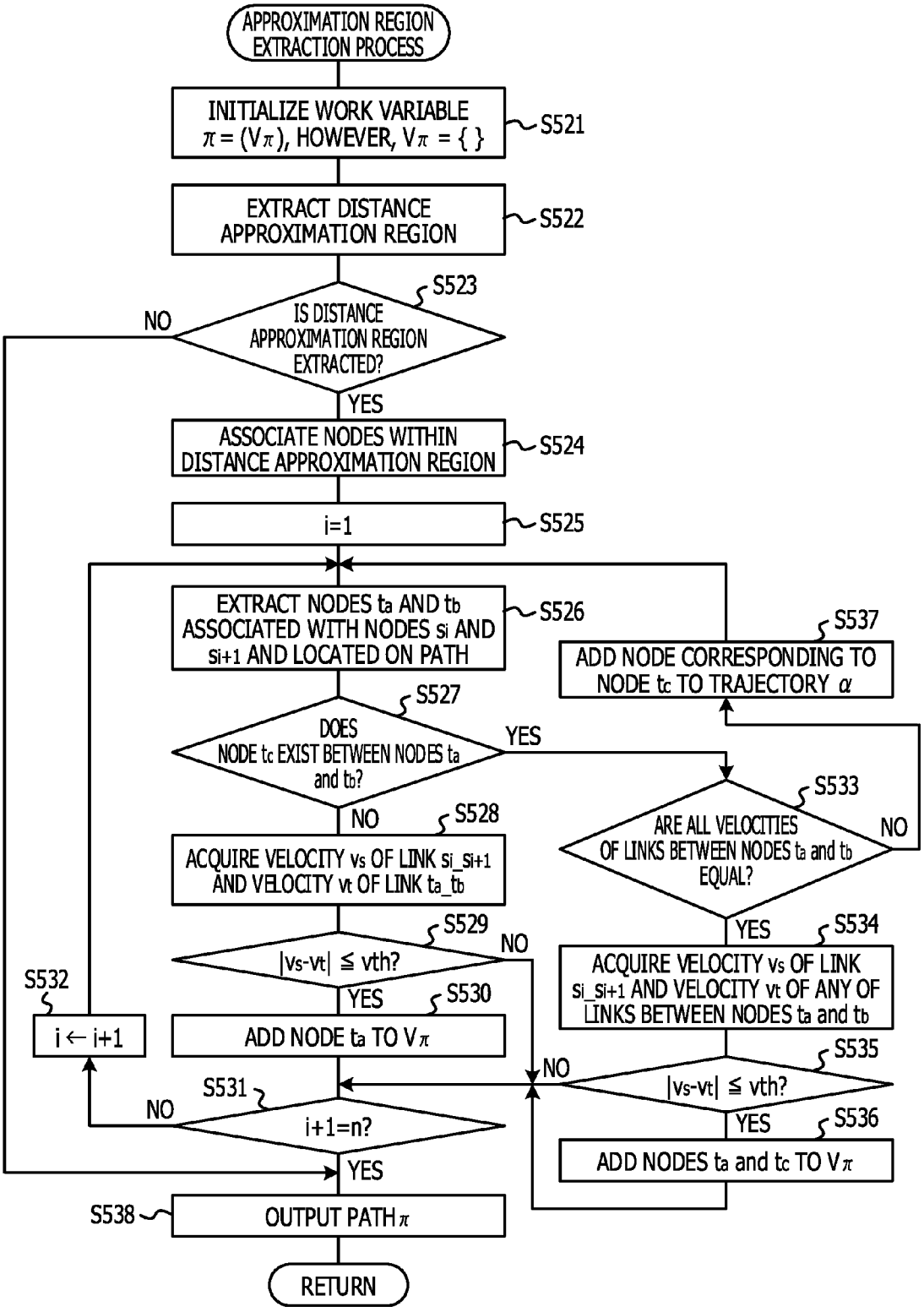
FIG. 15 is a flowchart of an example of an approximation region extraction process.

In step S521 of the approximation region extraction process illustrated in FIG. 15, the planar graph generating unit 13 initializes a work variable to be used for the approximation region extraction process. Specifically, the planar graph generating unit 13 sets, to an empty set, a set $V_\pi$ of nodes that form a path $\pi$, included in the approximation region 105, of the partial path $\Pi$.

Next, in step S522, the planar graph generating unit 13 extracts the distance approximation region 104 in which distances between the partial path $\Pi$ included in the planar graph G and the trajectory $\alpha$ are equal to or smaller than the predetermined threshold $\epsilon$, as illustrated in FIG. 7, for example. As an algorithm for efficiently searching a path of which distances to the trajectory $\alpha$ are equal to or smaller than the threshold $\epsilon$, an algorithm that uses the Fréchet distance is known and used in the embodiment. The amount of data to be calculated by the algorithm is proportional to the length of the trajectory $\alpha$ and the size of the planar graph G.

Figure 16:
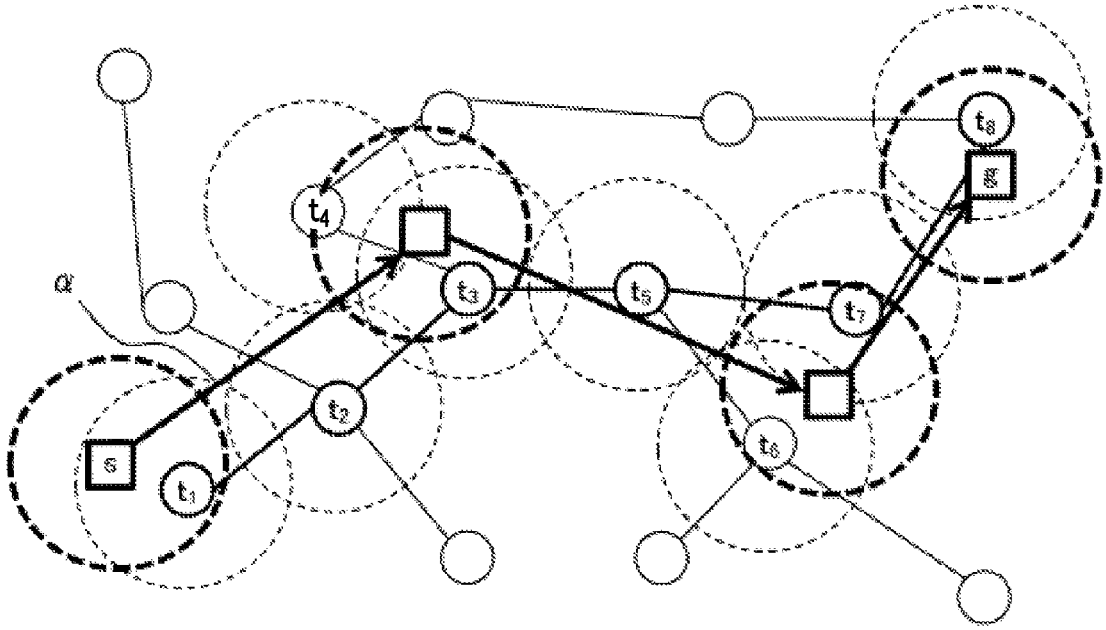
FIG. 16 is a diagram describing the extraction of the distance approximation region.

A specific method of extracting the distance approximation region 104 is described with reference to FIG. 16. In FIG. 16, circles indicate nodes of the planar graph G, and squares indicate nodes of the trajectory $\alpha$. As illustrated in FIG. 16, the planar graph generating unit 13 extracts a node $t_1$ that is included in the planar graph G and located in a circle that has a radius $\epsilon$ and whose center is the node s that is a start point of the trajectory $\alpha$. Subsequently, the planar graph generating unit 13 searches a node that is connected to the node $t_1$ by a link and located in a circle that intersects with the trajectory $\alpha$ and a circle that has the radius $\epsilon$ and whose center is the node $t_1$. Then, the planar graph generating unit 13 extracts the searched node $t_2$. In this manner, the planar graph generating unit 13 extracts nodes $t_3$, $t_4$, $t_5$, $t_6$, and $t_7$ by repeatedly executing breadth-first search from the node s serving as the start point of the trajectory $\alpha$ so as to search the nodes that are included in the planar graph G and whose distances to the trajectory $\alpha$ are equal to or smaller than $\epsilon$. When the planar graph generating unit 13 extracts a node $t_8$ that is the center of a circle including a node g serving as an end point of the trajectory $\alpha$, the search of the nodes is terminated. Then, the planar graph generating unit 13 acquires a path connecting the extracted nodes $t_1$, $t_2$, $t_3$, $t_5$, $t_7$, and $t_8$ to each other and extending from the node $t_1$ corresponding to the node s to the node $t_8$ corresponding to the node g. The planar graph generating unit 13 extracts, as the distance approximation region 104, a region including the acquired path and the trajectory $\alpha$.

If the planar graph G does not include a node whose distance to the node s serving as the start point of the trajectory $\alpha$ is equal to or smaller than $\epsilon$, the planar graph generating unit 13 sets a node next to the node s to the start point of the trajectory $\alpha$ and executes the same process as described above. If the planar graph G does not include a node whose distance to the node g serving as the end point of the trajectory $\alpha$ is equal to or smaller than $\epsilon$, the planar graph generating unit 13 may set, to the end point of the trajectory $\alpha$, a certain node that is included in the trajectory $\alpha$ and from which a node that is included in the planar graph G and whose distance to the certain node is equal to or smaller than $\epsilon$ is searched last.

Next, in step S523, the planar graph generating unit 13 determines whether or not the distance approximation region 104 is extracted in the aforementioned step S522. If the distance approximation region 104 is extracted, the process proceeds to step S524. If the distance approximation region 104 is not extracted, the process proceeds to step S538.

In step S524, the planar graph generating unit 13 associates a node included in the trajectory $\alpha$ and located in the distance approximation region 104 with a node that is included in the partial path $\Pi$ and whose distance to the node of the trajectory $\alpha$ is equal to or smaller than $\epsilon$ and smallest among nodes included in the partial path $\Pi$ and located in the distance approximation region 104. The association of the nodes may be executed simultaneously with the extraction of the distance approximation region 104 using the Fréchet distance. Thus, the association of the nodes may be executed at a high speed. If the partial path $\Pi$ does not include a node whose distance to a node of the trajectory $\alpha$ is equal to or smaller than $\epsilon$, the planar graph generating unit 13 adds a node onto the partial path $\Pi$ to ensure that a distance between the added node and the node of the trajectory $\alpha$ is equal to or smaller than $\epsilon$, and the planar graph generating unit 13 associates the added node with the node of the trajectory $\alpha$. The planar graph generating unit 13 sets nodes of the trajectory $\alpha$ to nodes $s_1, s_2, \ldots, s_n$ (n is the number of the nodes, included in the distance approximation region 104, of the trajectory $\alpha$) in order from the node s. In addition, the planar graph generating unit 13 sets nodes of the partial path $\Pi$ to nodes $t_1, t_2, \ldots, t_m$ (m is the number of the nodes, including the added node and included in the distance approximation region 104, of the partial path $\Pi$) in order from a node associated with the node s and included in the partial path $\Pi$.

Figure 17:
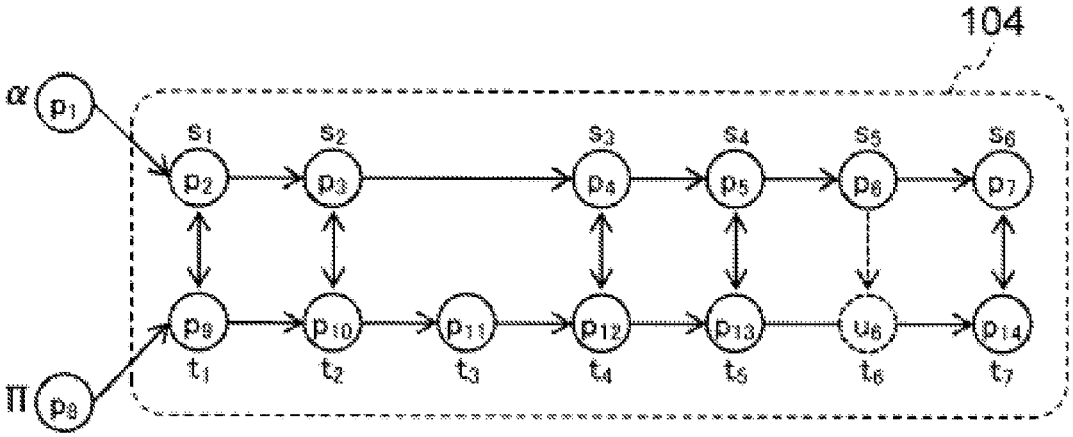
FIG. 17 is a diagram describing the comparison of velocities of a trajectory with velocities of a path.

A specific example is described below. As illustrated in FIG. 17, it is assumed that the distance approximation region 104 of the trajectory $\alpha$ and the partial path $\Pi$ is extracted. It is assumed that the node $p_2$ of the trajectory $\alpha$ is associated with the node $p_9$ of the partial path $\Pi$, the node $p_3$ of the trajectory $\alpha$ is associated with the node $p_{10}$ of the partial path $\Pi$, the node $p_4$ of the trajectory $\alpha$ is associated with the node $p_{12}$ of the partial path $\Pi$, the node $p_5$ of the trajectory $\alpha$ is associated with the node $p_{13}$ of the partial path $\Pi$, and the node $p_7$ of the trajectory $\alpha$ is associated with the node $p_{14}$ of the partial path $\Pi$. In addition, it is assumed that the partial path $\Pi$ does not include a node whose distance to the node $p_6$ of the trajectory $\alpha$ is equal to or smaller than $\epsilon$. A node $u_6$ whose distance to the node $p_6$ is equal to or smaller than $\epsilon$ is added onto the partial path $\Pi$. The node $u_6$ may be added to a link of the partial path $\Pi$ and located at a position at which a distance between the node $u_6$ and the node $p_6$ is smallest. In addition, the node $u_6$ may be added as an internally dividing point onto the link $p_{13}_p_{14}$, corresponding to the nodes $p_5$ and $p_7$ located before and after the node $p_6$ of the trajectory $\alpha$, of the partial path $\Pi$ so as to ensure that a ratio of a distance between the nodes $p_{13}$ and $u_6$ and a distance between the nodes $u_6$ and $p_{14}$ is equal to a ratio of the length of a link $p_5_p_6$ and the length of a link $p_6_p_7$.

Next, in step S525, the planar graph generating unit 13 sets a variable i to 1. Next, in step S526, the planar graph generating unit 13 extracts nodes $t_a$ and $t_b$ of the partial path $\Pi$ that are associated with nodes $s_i$ and $s_{i+1}$ of the trajectory $\alpha$. In the example illustrated in FIG. 17, if i=1, a node $t_1$ ($p_9$) is extracted as the node $t_a$, and a node $t_2$ ($p_{10}$) is extracted as the node $t_b$.

Next, in step S527, the planar graph generating unit 13 determines whether or not another node $t_c$ of the partial path $\Pi$ exists between the nodes $t_a$ and $t_b$. If the node $t_c$ does not exist, the process proceeds to step S528. If the node $t_c$ exists, the process proceeds to step S533.

Figure 18:
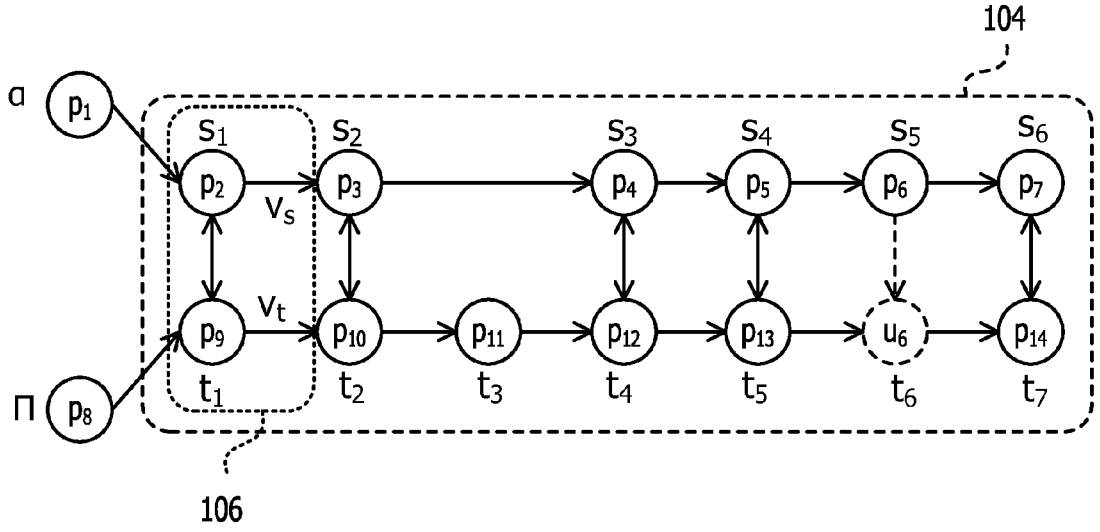
FIG. 18 is a diagram describing the comparison of the velocities of the trajectory with the velocities of the path.

In step S528, the planar graph generating unit 13 acquires, from velocity information provided to the trajectory data item $\alpha$ and the planar graph G and stored in the predetermined storage region, a velocity $v_s$ of a link $s_i_s_{1+1}$ and a velocity $v_t$ of a link $t_a_t_b$, as illustrated in FIG. 18. Next, in step S529, the planar graph generating unit 13 determines whether or not the difference between the velocity $v_s$ of the link $s_i_s_{i+1}$ and the velocity $v_t$ of the link $t_a_t_b$ is equal to or smaller than the predetermined threshold vth. If the difference between the velocities $v_s$ and $v_t$ is equal to or smaller than the predetermined threshold vth, the process proceeds to step S530. If the difference between the velocities $v_s$ and $v_t$ exceeds the predetermined threshold vth, the process proceeds to step S531.

In step S530, the planar graph generating unit 13 determines that a region (indicated by a broken line 106 illustrated in FIG. 18) that includes the nodes $s_i$ and $t_a$, the link $s_i_s_{i+1}$, and the link $t_a_t_b$ is a part of the approximation region 105. Since a part of the partial path $\Pi$ that is included in the approximation region 105 is the path $\pi$, the planar graph generating unit 13 adds a node data item indicating the node $t_a$ to the node set $V_\pi$ of the path $\pi$.

Next, in step S531, the planar graph generating unit 13 determines whether or not i+1=n and thereby determines whether or not the node $s_{i+1}$ is an end point of the trajectory $\alpha$ that is included in the distance approximation region 104. If i+1=n, the process proceeds to step S538. If i+1 does not reach n, the process proceeds to step S532, the planar graph generating unit 13 increments the variable i by 1, and the process returns to step S526.

Figure 19:
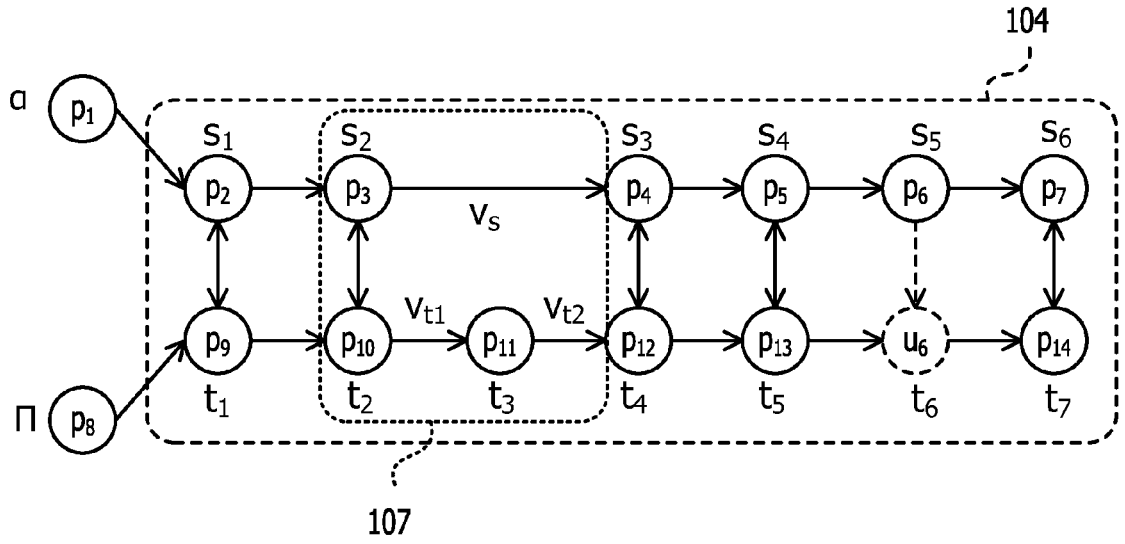
FIG. 19 is a diagram describing the comparison of the velocities of the trajectory with the velocities of the path.

For example, as illustrated in FIG. 19, if i=2, the node $t_3$ ($p_{11}$) or $t_c$ exists between the node $t_2$ ($p_{10}$) or $t_a$ and the node $t_4$ ($p_{12}$) or $t_b$, the answer to the determination of the aforementioned step S527 is affirmative, and the process proceeds to step S533.

In step S533, the planar graph generating unit 13 acquires velocity information of all links between the nodes $t_a$ and $t_b$. In the example illustrated in FIG. 19, the planar graph generating unit 13 acquires a velocity $v_{t1}$ of a link $t_a_t_c$ and a velocity $v_{t2}$ of a link $t_c_t_b$. If multiple nodes $t_c$ exist between the nodes $t_a$ and $t_b$, the planar graph generating unit 13 also acquires velocities of links $t_{cj}_t_{cj+1}$ (j=1, 2, . . . , J−1, (J is the number of the nodes $t_c$). Then, the planar graph generating unit 13 determines whether or not all the velocities of the links between nodes $t_a$ and $t_b$ are equal to each other. If all the velocities are equal to each other, the process proceeds to step S534. If a link whose velocity is different from the other velocities exists among all the velocities, the process proceeds to step S537.

In step S534, the planar graph generating unit 13 acquires the velocity $v_s$ of the link $s_i_s_{i+1}$ and a velocity $v_t$ of any of the links existing between the $t_a$ and $t_b$. Next, in step S535, the planar graph generating unit 13 determines whether or not the difference between the velocities $v_s$ and $v_t$ is equal to or smaller than the predetermined threshold vth. If the difference between the velocities $v_s$ and $v_t$ is equal to or smaller than the predetermined threshold vth, the process proceeds to step S536. If the difference between the velocities $v_s$ and $v_t$ exceeds the predetermined threshold vth, the process proceeds to step S531.

In step S536, the planar graph generating unit 13 determines that a region (indicated by a broken line 107 illustrated in FIG. 19) that includes the nodes $s_1$, $t_a$, and $t_c$, the link $s_i_s_{i+1}$, and all the links existing between the nodes $t_a$ and $t_b$ is a part of the approximation region 105. Then, the planar graph generating unit 13 adds node data items indicating the nodes $t_a$ and $t_c$ to the node set $V_\pi$ of the path $\pi$, and the process proceeds to step S531.

On the other hand, if the planar graph generating unit 13 determines that the link whose velocity is different from the other velocities exists between the nodes $t_a$ and $t_b$, and the process proceeds to step S537, the planar graph generating unit 13 adds, onto the link $s_i_s_{i+1}$ of the trajectory $\alpha$, a node corresponding to the node $t_c$. In addition, the planar graph generating unit 13 resets the nodes of the trajectory $\alpha$ to the nodes $s_1, s_2, \ldots, s_n$ (n is the number of the nodes, including the added node and included in the distance approximation region 104, of the trajectory $\alpha$) in order from the node $s_1$. The addition of the node may be executed in the same manner as the method of adding the node onto the partial path $\Pi$ and associating the added node with the node of the trajectory $\alpha$ in the aforementioned step S524. When the node is added, the process returns to step S526.

Figure 20:
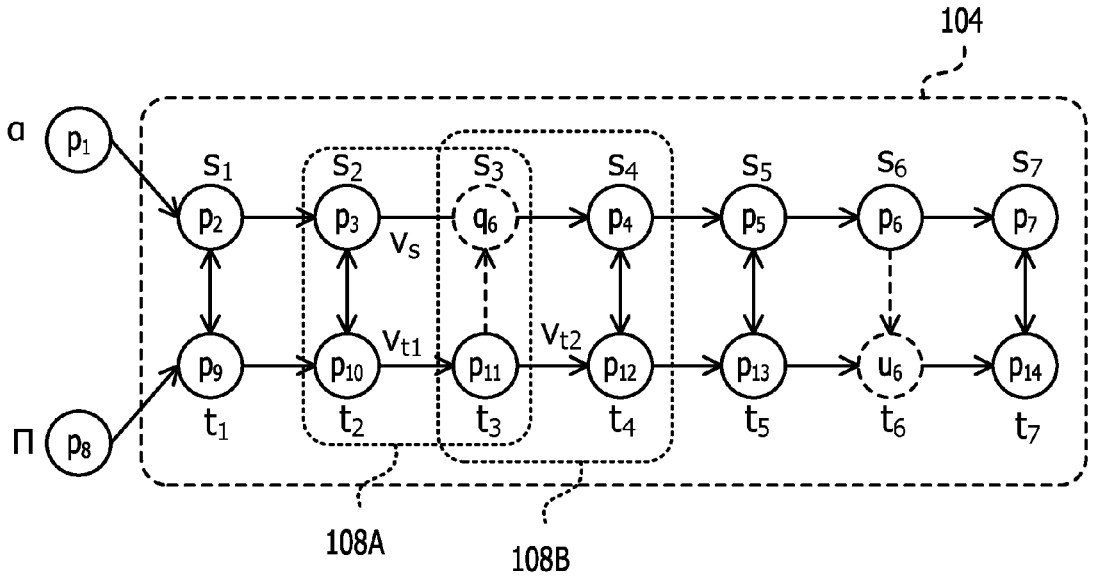
FIG. 20 is a diagram describing the comparison of the velocities of the trajectory with the velocities of the path.

For example, as illustrated in FIG. 20, the planar graph generating unit 13 adds, onto the link $s_i_s_{i+1}$ of the trajectory $\alpha$, the node $q_6$ corresponding to the node $t_3$ ($p_{11}$) or tc located on the partial path $\Pi$ and resets the nodes of the trajectory $\alpha$ to the nodes $s_1, s_2, \ldots, s_n$. If multiple nodes $t_c$ exist between the nodes $t_a$ and $t_b$, the planar graph generating unit 13 adds nodes corresponding to the nodes $t_c$ onto the link $s_i_s_{i+1}$ of the trajectory $\alpha$. After that, the process proceeds to step S526, and the planar graph generating unit 13 compares velocities with each other for each of parts (indicated by broken lines 108A and 108B in FIG. 20) at which velocities added to links of the partial path $\Pi$ are different from other velocities and executes the process of extracting the approximation region 105, as illustrated in FIG. 20.

In step S538, the planar graph generating unit 13 outputs the node set $V_\pi$ as the path $\pi$, included in the approximation region 105, of the partial path $\Pi$. If the distance approximation region 104 is not extracted in the aforementioned step S523 or if a part of the approximation region 105 is not extracted in S529 or S535, the planar graph generating unit 13 outputs, as the node set $V_\pi$, an empty node that indicates that the approximation region 105 is not extracted. Then, the process returns to the trajectory data addition process illustrated in FIG. 14.

Figure 21:
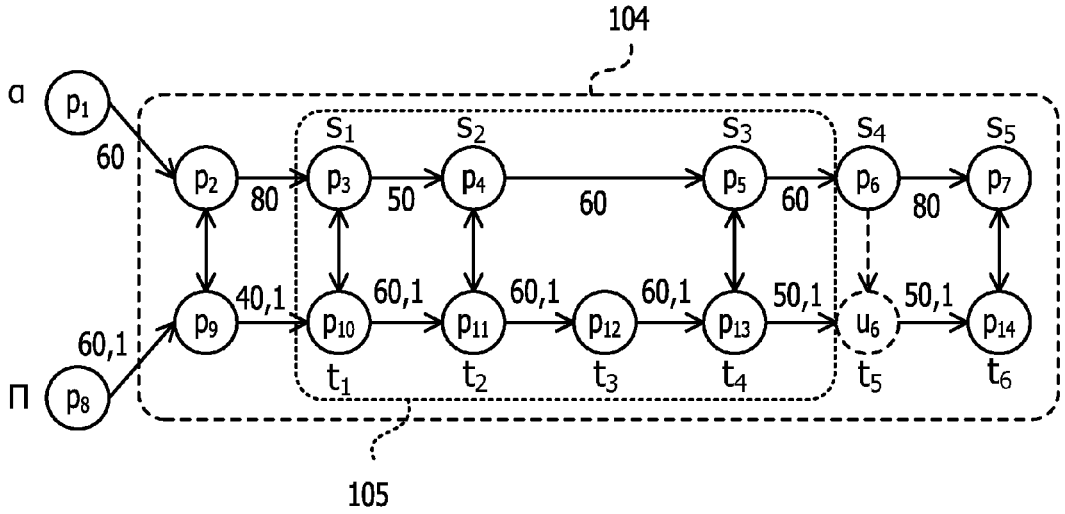
FIG. 21 is a diagram describing the addition of a trajectory data item to a planar graph.

Next, in step S54 of the trajectory data addition process illustrated in FIG. 14, the planar graph generating unit 13 determines whether or not the node s is included in the approximation region 105. Specifically, if the node set $V_\pi$, output in the aforementioned step S52, of the path $\pi$ includes a node, associated with the node s, of the partial path $\Pi$, the planar graph generating unit 13 may determine that the node s is included in the approximation region 105. If the node set $V_\pi$, output in the aforementioned step S52, of the path $\pi$ is an empty set, or if the approximation region 105 is not extracted, or if the node s exists outside the approximation region 105, the planar graph generating unit 13 determines that the node s is not included in the approximation region 105, and the process proceeds to step S56. For example, as illustrated in FIG. 21, if the approximation region 105 is extracted, the node p is nil, and the node s is the node $p_1$, the planar graph generating unit 13 determines that the node s exists outside the approximation region 105, and the process proceeds to step S56.

In step S56, the planar graph generating unit 13 determines whether or not the node p is "nil". If the node p is not nil, the process proceeds to step S57. If the node p is nil, the process proceeds to step S59. In the aforementioned example, since the node p is nil, the planar graph generating unit 13 determines that the node p is nil and the process proceeds to step S59.

In step S59, the planar graph generating unit 13 sets the node s to the node p and sets a node immediately after the node s to the node s. In the example illustrated in FIG. 21, the node p is set to the node $p_1$ and the node s is set to the node $p_2$. Next, in step S60, the planar graph generating unit 13 determines whether or not the node s is the end point of the trajectory α. If the node s is not the end point of the trajectory α, the process returns to step S54.

Since the node $p_2$ is not included in the approximation region 105 and the node $p_1$ is not nil, the process proceeds to step S57. In step S57, the planar graph generating unit 13 adds the node p to the node set V and adds a link p_s to the link set E, and the cost calculating unit 14 adds 1 to a cost variable A. In this example, the node $p_1$ is added to the node set V, and the link $p_1_p_2$ is added to the link set E.

Next, in step S58, the planar graph generating unit 13 provides, to the link p_s added to the link set E, velocity information added to the link p_s of the trajectory α and sets a frequency to 1. The frequency indicates the number of times when a trajectory data item is integrated into any of links of the planar graph. The frequency is information that is used when a velocity added to a link is updated upon the integration of a trajectory data item into the planar graph. In FIG. 21, a preceding number provided to each link of the planar graph indicates a velocity, and a succeeding number provided to each link of the planar graph indicates a frequency. In the example illustrated in FIG. 21, velocity information "60, 1" is provided to the link $p_1_p_2$ provided to the link set E.

In the next step S59, the planar graph generating unit 13 sets the node p to the node $p_2$ and sets the node s to the node $p_3$. Since the node $p_3$ is included in the approximation region 105, the answer to the determination of the aforementioned step S54 is affirmative, and the process proceeds to step S61.

In step S61, the planar graph generating unit 13 determines whether or not the node p is "nil". If the node p is not nil, the process proceeds to step S62. If the node p is nil, the process proceeds to step S68. In this example, since the node p is the node $p_2$, the process proceeds to step S62.

In step S62, the planar graph generating unit 13 adds the node p to the node set V and the cost calculating unit 14 adds 1 to the cost variable A. In this example, the node $p_2$ is added to the node set V.

Next, in step S63, the planar graph generating unit 13 sets a node string, included in the approximation region 105, of the trajectory α to $s_1, s_2, \ldots, s_n$ and sets a node string of the path π to $t_1, t_2, \ldots, t_m$. Then, the planar graph generating unit 13 sets the node p to the node $t_0$, adds a link $t_0_t_1$ to the link set E, and adds a velocity 0 and a frequency 0 as velocity information to the link $t_0_t_1$. In an example illustrated in FIG. 21, if the node p is the node $p_2$, the planar graph generating unit 13 adds a link $p_2_p_{10}$ to the link set E and provides a velocity 0 and a frequency 0 as velocity information to the link $p_2_p_{10}$. This velocity information is updated to a velocity 80 and frequency 1 (80, 1) provided to the link $p_2_p_3$ by a process described later if the node $p_{10}$ is included in the node set V.

In step S64, the planar graph generating unit 13 determines whether or not a node $t_{i+1}$ is included in the node set V of the planar graph G. In this case, i is 0, 1, . . . , m−1. The following processes of steps S66 and S67 are executed on each node i, or processes of steps S69 to S72 and the processes of steps S66 and S67 are executed based on determination of step S65. If the node $t_{i+1}$ is included in the node set V of the planar graph G, the process proceeds to step S66. If the node $t_{i+1}$ is a node added upon the association of the nodes in step S524 of the aforementioned approximation region extraction process (illustrated in FIG. 15), the node $t_{i+1}$ is not included in the node set V, the answer to the determination of step S64 is negative, and the process proceeds to step S65.

In step S66, the planar graph generating unit 13 acquires a link including the node $t_1$ and $t_{i+1}$ from the link set E and sets the acquired link to a link h_h'.

Next, in step S67, the planar graph generating unit 13 extracts nodes $s_1$ and $s_{i+1'}$, associated with the nodes $t_1$ and $t_{i+1}$, of the trajectory α. As illustrated in FIG. 21, the trajectory α does not include a node associated with the node $t_3$ ($p_{12}$), for example. This is due to the fact that since the velocity does not change in the link $p_{11}_p_{12}$ and the link $p_{12}_p_{13}$, the association is executed without adding a node to the trajectory α in steps S533 and S534 of the aforementioned approximation region extraction process (illustrated in FIG. 15). In this case, it is sufficient if a node of the trajectory α that corresponds to a node that is closest to the node t and associated with a node of the trajectory α before the node t is extracted as the node $s_{i'}$, associated with to the node $t_i$, of the trajectory α. Similarly, it is sufficient if a node of the trajectory α that corresponds to a node that is closest to the node $t_{i+1}$ and associated with a node of the trajectory α after the node $t_{i+1}$ is extracted as the node $s_{i+1'}$, associated with the node $t_{i+1}$, of the trajectory α. In the example illustrated in FIG. 21, if the nodes t and $t_{i+1}$ are the node $p_{11}$ and $p_{12}$, the nodes $p_4$ and $p_5$ are extracted as the nodes $s_1$ and $s_{i+1'}$.

Then, the planar graph generating unit 13 acquires a velocity v' provided to the link $s_{i'}_s_{i+1'}$ and a velocity v and frequency k of the link h_h' and updates the velocity of the link h_h' by (k×v+v')/k+1. In addition, the planar graph generating unit 13 adds 1 to the frequency k of the link h_h' and the process proceeds to step S68.

In step S65, the planar graph generating unit 13 determines whether or not i+1 is equal to 1 or m. If i+1 is equal to 1 or m, the process proceeds to step S69.

In step S69, the planar graph generating unit 13 acquires a link including the nodes t and $t_{i+1}$ from the link set E and sets the acquired link to the link h_h'. In the example illustrated in FIG. 21, if the node $t_5$ ($u_6$) that is the node $t_{i+1}$ is not included in the node set V, the planar graph generating unit 13 acquires the link $p_{13}_p_{14}$ from the link set E and sets the acquired link $p_{13}_p_{14}$ to the link h_h'.

Next, in step S70, the planar graph generating unit 13 adds the node $t_{i+1}$ to the node set V and the cost calculating unit 14 adds 1 to the cost variable A. Next, in step S71, the planar graph generating unit 13 adds, to the link set E, a link $h_t_{i+1}$ connecting the node h to the added node $t_{i+1}$ and a link $t_{i+1}_h'$ connecting the node $t_{i+1}$ to the node h' and deletes the link h_h' from the link set E.

Next, in step S72, the planar graph generating unit 13 acquires a velocity and frequency provided to the link h_h' and provides the acquired velocity and the acquired frequency to the links $h_t_{i+1}$ and $t_{i+1}_h'$. Then, the process proceeds to step S66.

In the aforementioned example in which the node $t_{i+1}$ is the node $u_6$, the link $p_{13}_p_{14}$ is deleted and the links $p_{13}_u_6$ and $u_6_p_{14}$ are added. The velocity information of the link $p_{13}_u_6$ is updated to a velocity 55 and a frequency 2 based on the velocity 60 of the link $p_5_p_6$ corresponding to the link $p_{13}_u_6$ and included in the trajectory $\alpha$ and the velocity information (indicating the velocity 50 and the frequency 1) of the original link $p_{13}_p_{14}$.

Next, in step S68, the planar graph generating unit 13 sets a node $t_m$ to the node p and sets a node immediately after the node $s_n$ to the node s, and the process proceeds to step S60. If the node s is the end point of the trajectory $\alpha$, the answer to the determination of step S60 is affirmative and the process returns to the trajectory data search process illustrated in FIG. 13.

Since the cost is not calculated in the trajectory data addition process executed in step S34 illustrated in FIG. 13, the process of adding 1 to the cost variable A may be omitted in the aforementioned steps S57, S62, S65, and S70.

Figure 22:
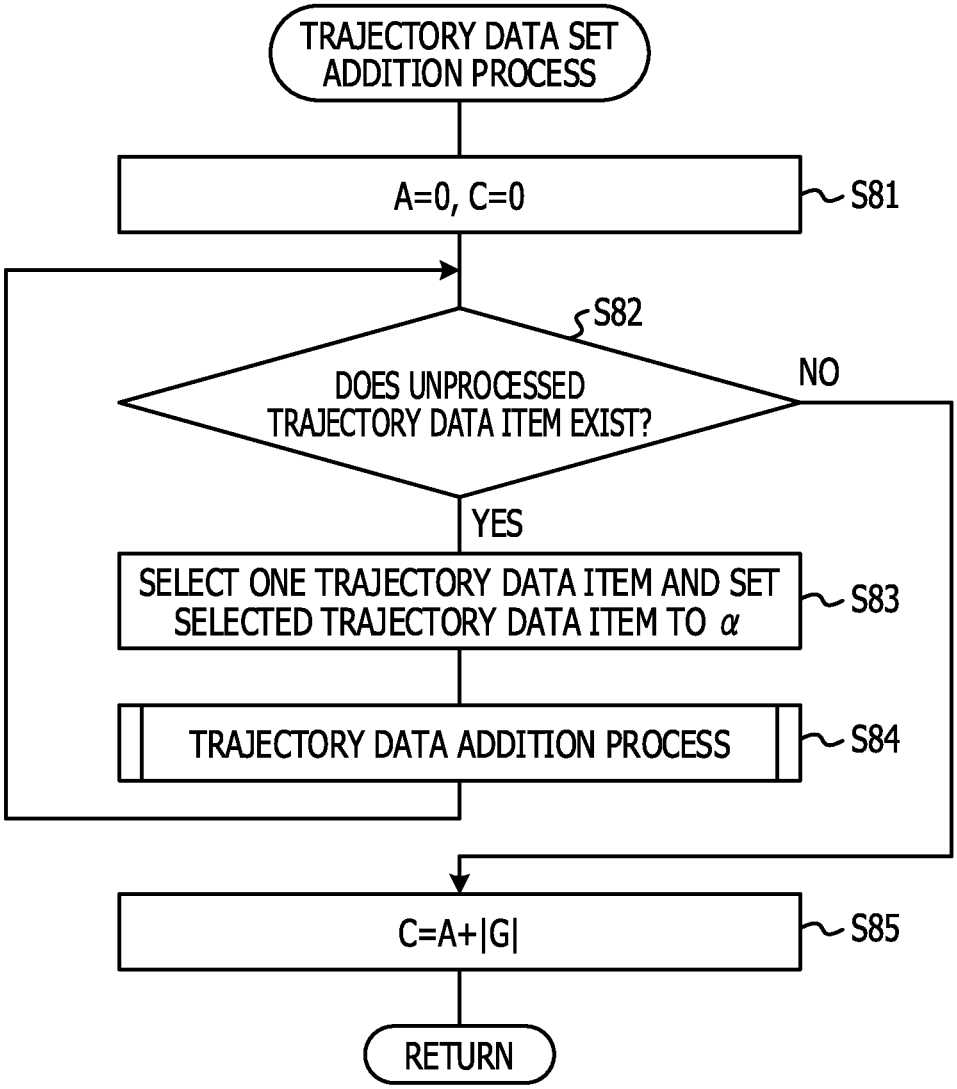
FIG. 22 is a flowchart of an example of a trajectory data set addition process.

Next, in step S35 of the trajectory data search process illustrated in FIG. 13, a trajectory data set addition process that is illustrated in FIG. 22 in detail is executed.

In step S81 of the trajectory data set addition process illustrated in FIG. 22, the cost calculating unit 14 initializes the cost variable A and the cost C to 0.

Next, in step S82, the trajectory data searching unit 12 determines whether or not a trajectory data item, which is included in the trajectory data set T and is not the trajectory data item selected in step S33 of the trajectory data search process (illustrated in FIG. 13) and is yet to be processed or yet to be added to the planar graph G, exists. If the unprocessed trajectory data item exists, the process proceeds to step S83.

In step S83, the trajectory data searching unit 12 selects, from the trajectory data set T, one of unprocessed trajectory data items other than the trajectory data item selected in the aforementioned step S33 and sets the selected trajectory data item to the trajectory data item $\alpha$. Next, in step S84, the trajectory data addition process illustrated in FIG. 14 is executed.

If an unprocessed trajectory data item does not exist, the answer to the determination of step S82 is negative and the process proceeds to step S85. In step S85, the cost calculating unit 14 calculates the number of nodes included in the planar graph G or the like as the cost |G| of the complexity of the planar graph G, adds the calculated number to the cost variable A, and thereby calculates the cost C. Then, the process returns to the trajectory data search process illustrated in FIG. 13.

Next, in step S36 of the trajectory data search process illustrated in FIG. 13, the trajectory data searching unit 12 determines whether or not the cost C is smaller than the minimum cost minC. If C<minC, the process proceeds to step S37, the planar graph generating unit 13 sets the trajectory data item $\alpha$ selected in the aforementioned step S33 to a trajectory data item $\alpha^*$ to be added to a planar graph G*, and the process returns to step S32. If C≥minC, the process returns to step S32 without setting the trajectory data item $\alpha$ to the trajectory data item $\alpha^*$.

If an unprocessed trajectory data item does not exist, the answer to the determination of step S32 is negative and the process proceeds to step S38. In step S38, the trajectory data searching unit 12 outputs the trajectory data item $\alpha^*$ and a cost C* of the planar graph G* having the trajectory data item $\alpha^*$ added thereto, and the process returns to the path graph generation process illustrated in FIG. 12.

Next, in step S40 of the path graph generation process illustrated in FIG. 12, the planar graph generating unit 13 determines whether or not the cost C* is smaller than the minimum cost minC. If C*<minC, the process proceeds to step S50 and the planar graph generating unit 13 executes the trajectory data addition process (illustrated in FIG. 14) on the trajectory data item $\alpha^*$. In step S51 of the trajectory data addition process executed in step S50, the process of setting the planar graph G* to the planar graph G is omitted. Thus, in each step of the trajectory data addition process illustrated in FIG. 14, V is interpreted as V*, and E is interpreted as E*.

In step S60, the trajectory data searching unit 12 deletes the trajectory data item $\alpha^*$ from the trajectory data set T and sets a cost C* to the minimum cost minC and the process returns to step S20.

If the planar graph generating unit 13 determines that C*≥minC in the aforementioned step S40, the cost C is not reduced from the planar graph G* upon the previous loop of steps 20 through 60, the loop of steps 20 through 60 is stopped, and the process proceeds to step S80. In step S80, the planar graph generating unit 13 executes the trajectory data set addition process (illustrated in FIG. 22) on a trajectory data item remaining in the trajectory data set T. In each step of the trajectory data addition process executed in step S84 of the trajectory data set addition process executed in step S80, V is interpreted as V*, and E is interpreted as E*. When the trajectory data set addition process is terminated, the process proceeds to step S90.

If the answer to the determination of the aforementioned step S20 is affirmative, the process proceeds to step S90.

In step S90, the planar graph G* generated at the current stage and treated as a final path graph, and the cost C* calculated for the planar graph G*, are output. Then, the path graph generation process is terminated.

The aforementioned process is described using a specific example.

For example, it is assumed that the following trajectory data set T that includes the multiple trajectories $\alpha_1$, $\alpha_2$, $\alpha_3$, and $\alpha_4$ illustrated in FIG. 2 is input to the path graph generating device 10.

The trajectory data set $T=\{\alpha_1, \alpha_2, \alpha_3, \alpha_4\}$ $\alpha_1=<p_1, p_2, p_3, p_4>$ $\alpha_2=<p_5, p_6, p_7, p_8, p_9>$ $\alpha_3=<p_{10}, p_{11}, p_{12}>$ $\alpha_4=<p_{13}, p_{14}>$ Then, the velocity information providing unit 11 provides the velocity information illustrated in FIG. 4 to the links between the nodes of the trajectories (in step S10).

Figure 23:
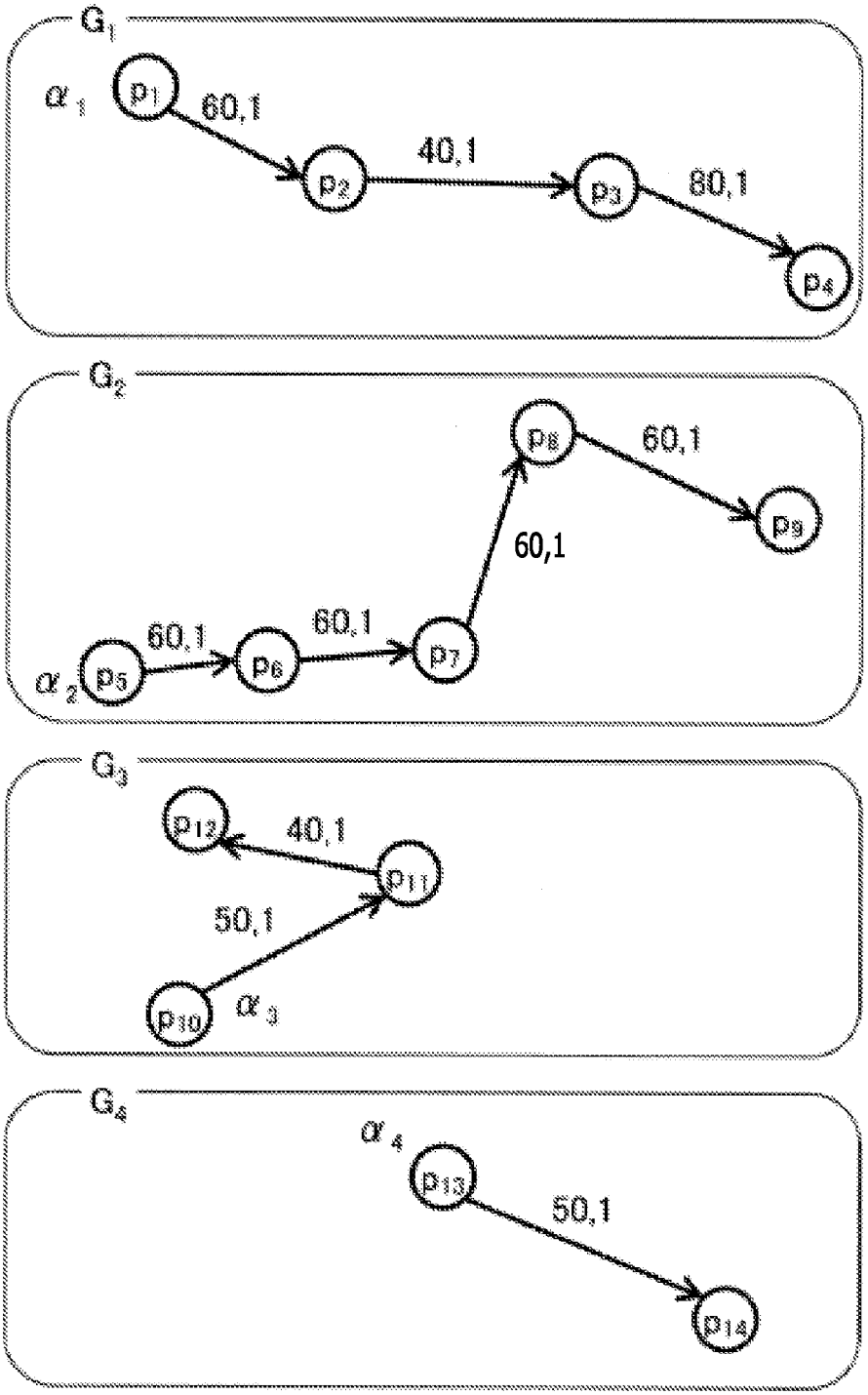
FIG. 23 is a diagram illustrating an example of intermediate planar graphs generated in the first loop of the path graph generation process.

In the first loop of the path graph generation process, the planar graph G is generated by adding the trajectory data items $\alpha_1$, $\alpha_2$, $\alpha_3$, and $\alpha_4$ to the planar graph G* (in steps S33 and S34). Since the node set V* and the link set E* are empty sets in an initial state, a planar graph $G_1$ obtained by adding the trajectory data item $\alpha_1$ to the planar graph G* is the trajectory $\alpha_1$, as illustrated in FIG. 23. Similarly, a planar graph $G_2$ obtained by adding the trajectory data item $\alpha_2$ to the planar graph G* is the trajectory $\alpha_2$, a planar graph $G_3$ obtained by adding the trajectory data item $\alpha_3$ to the planar graph G* is the trajectory $\alpha_3$, and a planar graph $G_4$ obtained by adding the trajectory data item $\alpha_4$ to the planar graph G* is the trajectory $\alpha_4$.

Next, costs $\delta(G, \alpha)$ of non-approximation of the trajectory data items other than the added trajectory data items to the planar graphs $G_1$, $G_2$, $G_3$, and $G_4$ are calculated (in step S35), as illustrated in FIG. 24, for example. In a table illustrated in FIG. 24, rows correspond to the planar graphs G, columns correspond to the trajectory data items $\alpha$, and each cell indicates a cost $\delta(G, \alpha)$ of non-approximation between a planar graph G corresponding to a row of the cell and a trajectory data item $\alpha$ corresponding to a column of the cell. As the costs $\delta(G, \alpha)$ of the non-approximation, the numbers of nodes that are not included in the approximation region 105 of the path II included in the planar graph G and the trajectory $\alpha$ are used. For example, in FIG. 24, the number (5) of nodes of the trajectory $\alpha_2$ indicates a cost $\delta(G, \alpha)$ since an approximation region 105 does not exist for the planar graph $G_1$ (trajectory $\alpha_1$) and the trajectory $\alpha_2$. When costs $|G|$ of complexity of the planar graphs G are added to the costs $\delta(G, \alpha)$ and the costs of the planar graphs G are calculated, the costs of the planar graphs G are expressed as follows.

$$C(G_1,\{\alpha_2,\alpha_3,\alpha_4\})=\delta(G_1,\alpha_2)+\delta(G_1,\alpha_3)+\delta(G_1,\alpha_4)+|G_1|=12$$

$$C(G_2,\{\alpha_1,\alpha_3,\alpha_4\})=\delta(G_2,\alpha_1)+\delta(G_2,\alpha_3)+\delta(G_2,\alpha_4)+|G_2|=12$$

$$C(G_3,\{\alpha_1,\alpha_2,\alpha_4\})=\delta(G_3,\alpha_1)+\delta(G_3,\alpha_2)+\delta(G_3,\alpha_4)+|G_3|=9$$

$$C(G_4,\{\alpha_1,\alpha_2,\alpha_3\})=\delta(G_4,\alpha_1)+\delta(G_4,\alpha_2)+\delta(G_4,\alpha_3)+|G_4|=12$$

Since the cost C of the planar graph G obtained by integrating the trajectory data item $\alpha_3$ to the planar graph G* is smallest, the trajectory data item $\alpha_3$ is selected as the trajectory data item $\alpha$ to be added to the planar graph G* (in steps S36, S37, and S38). Thus, the planar graph $G_3$ (trajectory $\alpha_3$) is generated as a new planar graph G* (in step S50). In addition, the trajectory data item $\alpha_3$ is deleted from the trajectory data set T (in step S60).

Figure 25:
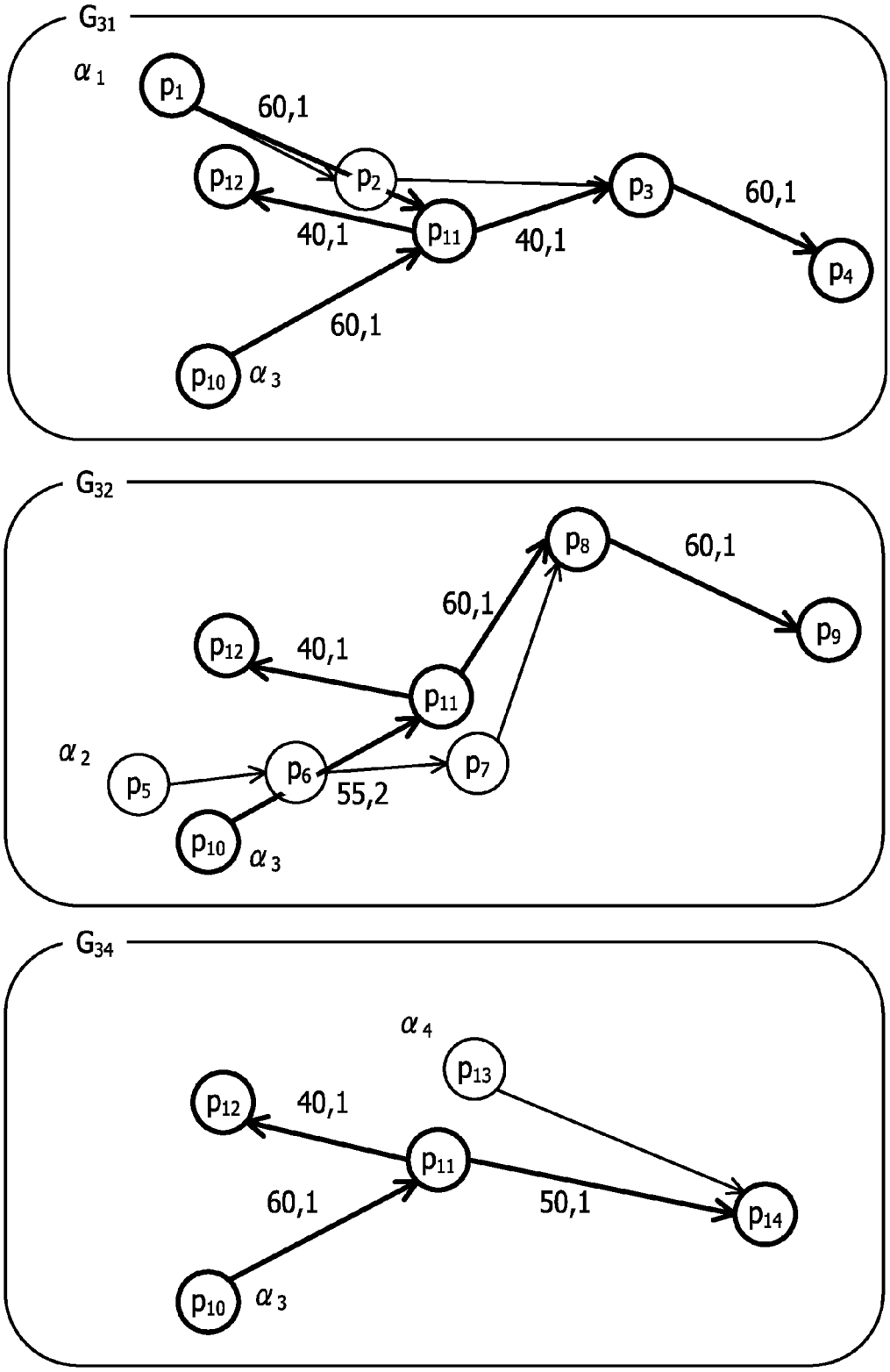
FIG. 25 is a diagram illustrating an example of intermediate planar graphs generated in the second loop of the path graph generation process.

In the next loop, planar graphs $G_{31}$, $G_{32}$, and $G_{34}$ are generated by adding the trajectory data items $\alpha_1$, $\alpha_2$, and $\alpha_4$ to the planar graph $G_3$ that is the planar graph G*, as illustrated in FIG. 25 (in steps S33 and S34). In FIG. 25, the generated planar graphs are indicated by solid lines, and the added trajectories are indicated by thin lines.

Next, costs $\delta(G, \alpha)$ of non-approximation of trajectory data items other than the added trajectory data items to the planar graphs $G_{31}$, $G_{32}$, and $G_{34}$ are calculated (in step S35), as illustrated in FIG. 26, for example. When the costs $|G|$ of the complexity of the planar graphs G are added to the costs $\delta(G, \alpha)$, and the costs of the planar graphs G are calculated, the costs of the planar graphs G are expressed as follows.

$$C(G_{31},\{\alpha_2,\alpha_4\})=\delta(G_{31},\alpha_2)+\delta(G_{31},\alpha_4)+|G_{31}|=9$$

$$C(G_{32},\{\alpha_1,\alpha_4\})=\delta(G_{32},\alpha_1)+\delta(G_{32},\alpha_4)+|G_{32}|=9$$

$$C(G_{34},\{\alpha_1,\alpha_2\})=\delta(G_{34},\alpha_1)+\delta(G_{34},\alpha_2)+|G_{34}|=9$$

The minimum value among the costs calculated upon the selection of the trajectory data items $\alpha^*$ in the previous loop is "9", and a cost that is smaller than "9" is not calculated in the current loop. Thus, the loop is stopped (in step S40). Then, a planar graph G* is generated by adding, to the planar graph G* ($G_3$), the trajectory data items $\alpha_1$, $\alpha_2$, and $\alpha_4$ remaining in the trajectory data set T (in step S80) and is set to the final path graph (in step S90)

Figure 27:
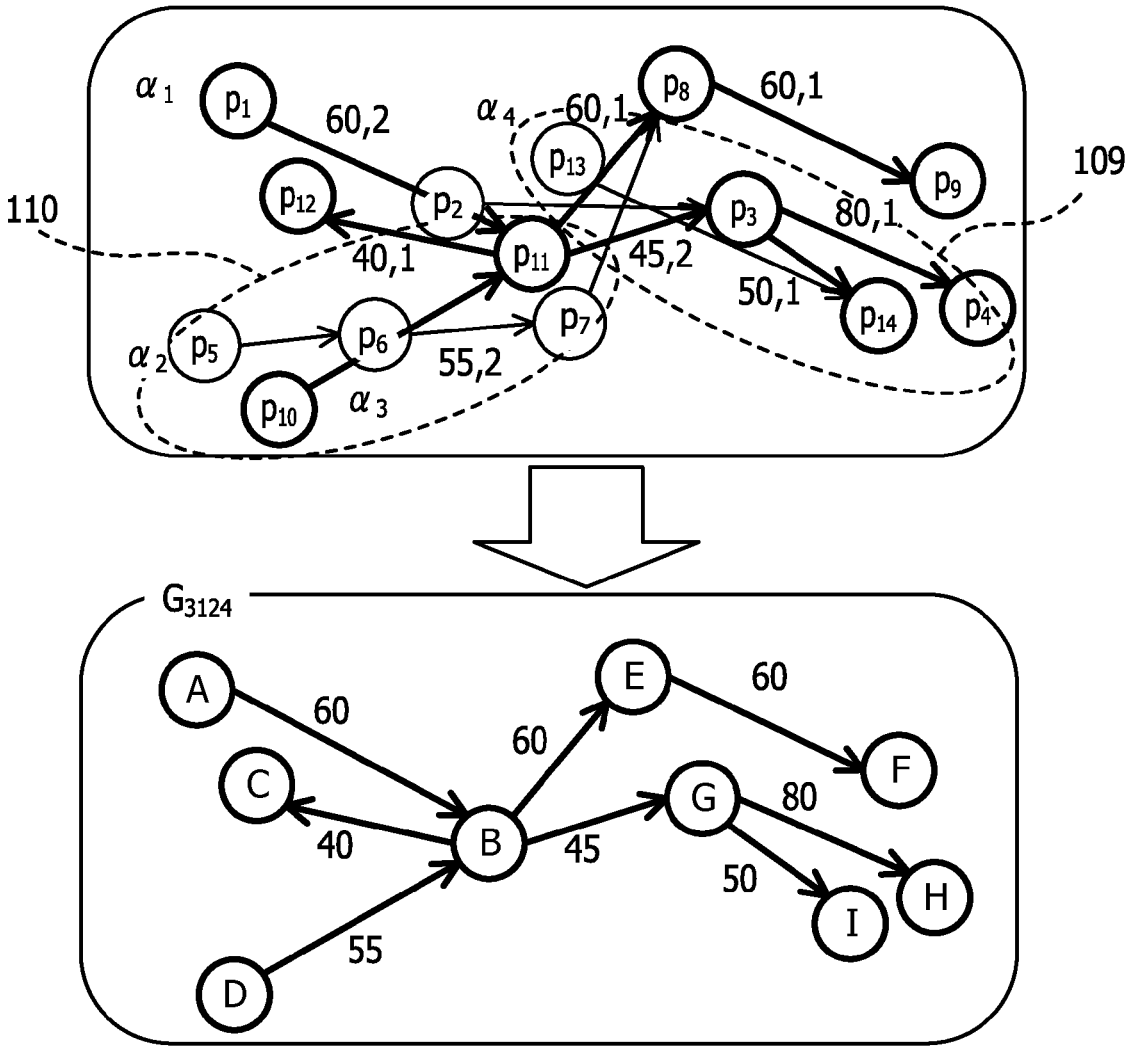
FIG. 27 is a diagram illustrating a state in which a path graph is generated by adding remaining trajectory data items to an intermediate planar graph.

FIG. 27 illustrates a state in which a planar graph $G_{3124}$ is generated by adding the trajectory data items $\alpha_1$, $\alpha_2$, and $\alpha_4$ to the planar graph $G_3$. In a region indicated by a broken line 109 in FIG. 27, parts at which velocities are different exist in intervals in which distances between the trajectories are equal to or smaller than the threshold $\epsilon$ exist. The integration, however, is executed based on the results of the comparison of the different velocities of the parts. In a region indicated by a broken line 110 in FIG. 27, nodes of one of the trajectories are not associated with nodes of the other trajectory on a one-to-one basis, all velocities provided to multiple links included in corresponding intervals are equal to each other, and the integration of the corresponding intervals is executed without adding a node.

As described above, the path graph generation device according to the embodiment not only compares distances between trajectories, but also compares differences between velocities provided to the trajectories for the integration of the trajectories indicating movement paths of moving bodies. Thus, the integration of the paths may be executed in consideration of the differences between the velocities of the moving bodies.

Figure 28:
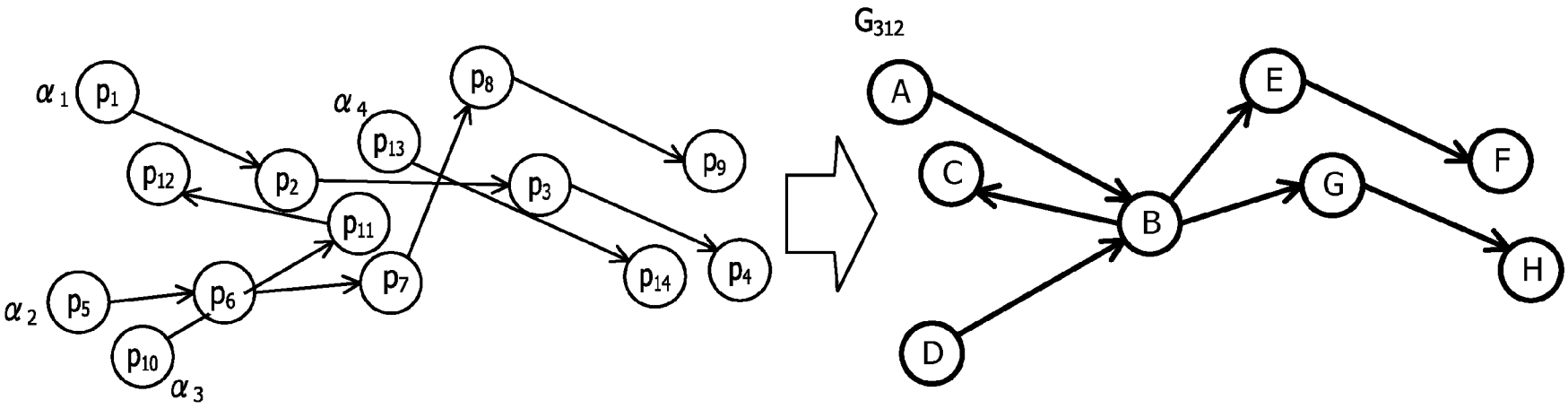
FIG. 28 is a diagram describing the generation of a path graph without consideration of velocities.
Figure 29:
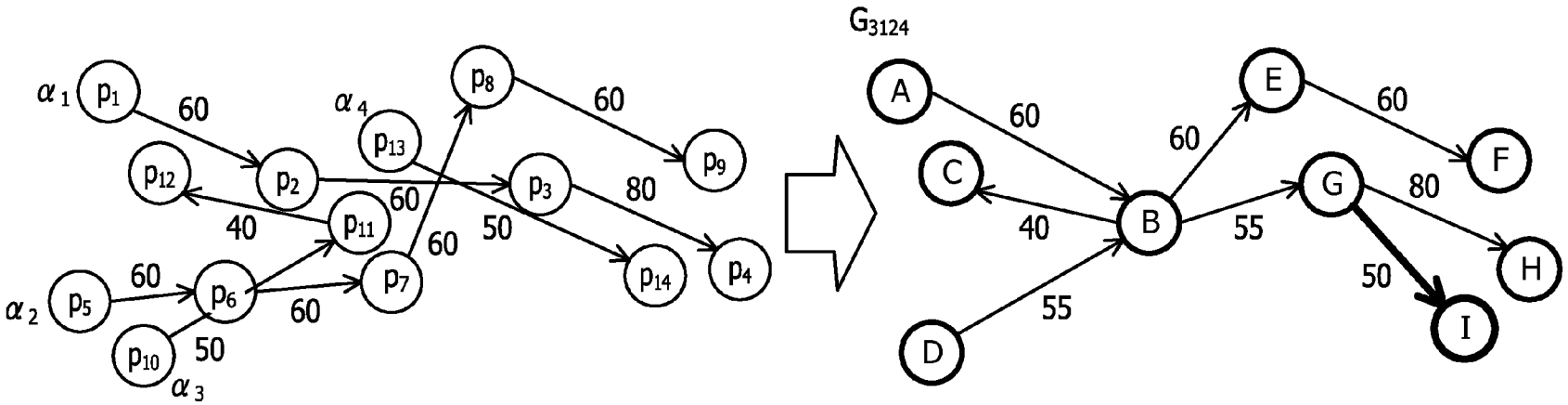
FIG. 29 is a diagram describing the generation of a path graph according to the embodiment.

For example, as illustrated in FIG. 28, in the generation of a path graph without consideration of velocities, the path graph is generated by integrating trajectories based on distances between the trajectories in a simple manner. In the embodiment, however, as illustrated in FIG. 29, the path graph is generated so as to ensure that parts at which velocities are different are different from each other in the path graph. Specifically, in the path graph illustrated in FIG. 28, a path that extends from a node G is only a path extending to a node H. On the other hand, in the path graph according to the embodiment that is illustrated in FIG. 29, a link G_H to which a velocity 80 is provided, and a link G_I to which a velocity 50 is provided, are included. Thus, the path graph illustrated in FIG. 29 is the detailed path graph generated in consideration of the velocities.

When the path analysis is executed using the generated path graph according to the embodiment, the original trajectory data items are mapped to the generated path graph. The mapping may be executed using degrees of approximation of distances between trajectories and paths of the path graph and degrees of approximation of velocities of the trajectories and paths of the path graph. In the example illustrated in FIG. 29, the trajectory data item $\alpha_1$ is mapped to a path extending from a node A through a node B and the node G to the node H, the trajectory data item $\alpha_2$ is mapped to a path extending from a node D through the node B and a node E to a node F, the trajectory data item $\alpha_3$ is mapped to a path extending from the node D through the node B to a node C, and the trajectory data item $\alpha_4$ is mapped to a path extending from the node B through the node G to the node I.

After the mapping is executed in the aforementioned manner, the path analysis (frequent partial path finding problem) may be executed to detect that paths through which two or more people pass are the following paths.

A path extending from the node B to the node G ($\alpha_1$ and $\alpha_4$)

A path extending from the node D to the node B ($\alpha_2$ and $\alpha_3$)

Based on this analysis, the node B is considered to be crowded. Consideration may be given to the fact that the crowdedness is expected to be mitigated by newly installing an intersection or a road.

For example, although a distance between the links G_H and G_I is small, the difference between the velocities provided to the links G_H and G_I is equal to or larger than the threshold, and the links G_H and G_I are separated from each other. Thus, the analysis may be executed in consideration of velocities of moving bodies in a case where a highway and a general road extend side by side, a case where there are roads on which moving bodies move at significantly different velocities, depending on a time zone, or the like.

The embodiment describes the case where whether or not both paths are integrated is determined based on distances between the paths and velocities provided to the paths. The embodiment is not limited to this. For example, a similarity between both paths that increases as the lengths of the paths are reduced and the difference between velocities provided to the paths is reduced may be calculated. Then, whether or not the paths are similar to each other may be determined based on the calculated similarity. In this case, each of the paths may be divided into multiple intervals so that the intervals of one of the paths are associated with the intervals of the other path, similarities between the intervals of one of the paths and the intervals of the other path may be calculated, and whether or not the paths are similar to each other may be determined based on statistical information such as the average of the calculated similarities, the maximum value among the calculated similarities, and the minimum value among the calculated similarities.

The embodiment describes the case where the optimal planar graph is generated based on the cost calculated using the costs of the non-approximation and the costs of the complexity. The embodiment is not limited to this. An evaluation value that indicates a feature of a planar graph that is appropriate for the path analysis may be calculated using distances between paths and velocities provided to the paths.

In the embodiment, the costs of the non-approximation are calculated from the distances between the paths and the differences between the velocities provided to the paths. An evaluation value related to the distances between the paths and an evaluation value related to the differences between the velocities may be calculated. For example, an evaluation value that is based on the number of elements such as nodes or links included in parts at which distances between paths are equal to or larger than the interested threshold, and an evaluation value that is based on the number of elements included in parts at which differences between velocities provided to the paths are equal to or larger than the interested threshold, may be calculated. The calculated evaluation values may be integrated by summing the evaluation values or summing the evaluation values weighted, and the integrated value may be used as a cost that indicates non-approximation between the paths.

The embodiment describes the case where the Fréchet distance is used for the calculation of distances between paths. The embodiment is not limited to this. Another distance such as an Euclidean distance may be used.

In the embodiment, in step S524 illustrated in FIG. 15, if the partial path Π does not include a node associated with a node of the trajectory α, a node is added to the partial path Π and associated with the node of the trajectory α. In the process of step S524, a node to be associated may be added to the partial path Π for an interval of the partial path Π only if parts at which velocities are different exist in an interval, corresponding to the interval of the partial path Π, of the trajectory α, like steps S533 and S537 illustrated in FIG. 15.

The embodiment describes the case where a two-dimensional path graph is generated from two-dimensional trajectory data items. However, positional data that includes information of latitudes and longitudes and information of heights may be acquired, and a three-dimensional path graph may be generated.

The case where the path graph generation program 50 that is the example of the movement path integration program disclosed herein is stored (installed) in the storage unit 46 in advance. The movement path integration program is not limited to this. The movement path integration program disclosed herein may be stored in a recording medium such as a CD-ROM, a DVD-ROM, or a USB memory and provided.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. An analysis method comprising:

acquiring first path information indicating a first movement path, first velocity information of a first moving body on the first movement path, second path information indicating a second movement path, and second velocity information of a second moving body on the second movement path;

calculating a similarity between the first velocity information and the second velocity information when the first path information and the second path information are extracted as candidates to be integrated;

determining by a computer, based on the similarity, whether the first path information and second path information are to be integrated with each other; and drawing at least a part of the first path information and at least a part of the second path information as a single path when it is determined that the first path information and the second path information are to be integrated with each other.

2. The analysis method according to claim 1, wherein the first path information indicates the first movement path that connects a plurality of first points through which the first moving body passes, and the second path information indicates the second movement path that connects a plurality of second points through which the second moving body passes.

3. The analysis method according to claim 2, wherein the first movement path is obtained by integrating specific two points among the plurality of first points with specific two points among the plurality of second points.

4. The analysis method according to claim 1, wherein, when the similarity is equal to or larger than a threshold, the first path information and the second path information are integrated with each other.

5. The analysis method according to claim 1, further comprising:

acquiring third path information indicating a third movement path and third velocity information of a third moving body on the third movement path;

calculating a similarity between the first velocity information and the third velocity information when the first path information and the third path information are extracted as the candidates to be integrated; and determining that the first path information and the third path information are not integrated with each other when the similarity between the first velocity information and the third velocity information is smaller than a threshold.

6. The analysis method according to claim 1, further comprising:

calculating a second similarity between the first movement path and the second movement path; and determining when the second similarity is equal to or larger than a threshold, wherein the second similarity is different than the similarity between the first velocity information and the second velocity information.

7. The analysis method according to claim 1, further comprising calculating a value based on the similarity and a complexity of temporarily generated graph information; and determining, based on the value, whether the first path information and the second path information are to be integrated with each other.

8. The analysis method according to claim 1, wherein the drawing is based on graph information generated by integrating, into the first path, a part that is included in the second movement path and whose distance to the first movement path is equal to or smaller than a threshold and at which the difference between a movement velocity of the first moving body and a movement velocity of the second moving body is equal to or smaller than a velocity threshold.

9. An analyzing device comprising:

a memory; and a processor coupled to the memory and configured to:

acquire first path information indicating a first movement path, first velocity information of a first moving body on the first movement path, second path information indicating a second movement path, and second velocity information of a second moving body on the second movement path, calculate a similarity between the first velocity information and the second velocity information when the first path information and the second path information are extracted as candidates to be integrated, determine, based on the similarity, whether the first path information and second path information are to be integrated with each other, and cause the processor or a computer to draw at least a part of the first path information and at least a part of the second path information as a single path when it is determined that the first path information and the second path information are to be integrated with each other.

10. The analyzing device according to claim 9, wherein the first path information indicates the first movement path that connects a plurality of first points through which the first moving body passes, and the second path information indicates the second movement path that connects a plurality of second points through which the second moving body passes.

11. The analyzing device according to claim 10, wherein the first movement path is obtained by integrating specific two points among the plurality of first points with specific two points among the plurality of second points.

12. The analyzing device according to claim 9, wherein, when the similarity is equal to or larger than a threshold, the first path information and the second path information are integrated with each other.

13. The analyzing device according to claim 9, wherein the processor is configured to:

acquire third path information indicating a third movement path and third velocity information of a third moving body on the third movement path, calculate a similarity between the first velocity information and the third velocity information when the first path information and the third path information are extracted as the candidates to be integrated, and determine that the first path information and the third path information are not integrated with each other when the similarity between the first velocity information and the third velocity information is smaller than a threshold.

14. The analyzing device according to claim 9, wherein the processor is configured to:

calculate a second similarity between the first movement path and the second movement path, and determine when the second similarity is equal to or larger than a threshold, wherein the second similarity is different than the similarity between the first velocity information and the second velocity information.

15. The analyzing device according to claim 9, wherein the processor is configured to:

calculate a value based on the similarity and a complexity of temporarily generated graph information, and determine, based on the value, whether the first path information and the second path information are to be integrated with each other.

16. The analyzing device according to claim 9, wherein the drawing is based on graph information generated by integrating, into the first path, a part that is included in the second movement path and whose distance to the first movement path is equal to or smaller than a threshold and at which the difference between a movement velocity of the first moving body and a movement velocity of the second moving body is equal to or smaller than a velocity threshold.

17. A non-transitory storage medium storing an analysis program which causes a computer to execute a process, the process comprising:

acquiring first path information indicating a first movement path, first velocity information of a first moving body on the first movement path, second path information indicating a second movement path, and second velocity information of a second moving body on the second movement path;

calculating a similarity between the first velocity information and the second velocity information when the first path information and the second path information are extracted as candidates to be integrated;

determining, based on the similarity, whether the first path information and second path information are to be integrated with each other; and causing the computer or another computer to draw at least a part of the first path information and at least a part of the second path information as a single path when it is determined that the first path information and the second path information are to be integrated with each other.

* * * * *